US011349262B2

(12) United States Patent
Chung et al.

(10) Patent No.: US 11,349,262 B2
(45) Date of Patent: May 31, 2022

(54) ELECTRICAL CONNECTOR ASSEMBLY WITH HIGH SPEED HIGH DENSITY SYMMETRICAL CONTACT ARRANGEMENT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chih-Ping Chung, New Taipei (TW); Chun-Hsiung Hsu, New Taipei (TW); Kuei-Chung Tsai, New Taipei (TW); Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/985,613

(22) Filed: Aug. 5, 2020

(65) Prior Publication Data

US 2021/0351536 A1 Nov. 11, 2021

Related U.S. Application Data

(60) Provisional application No. 63/022,492, filed on May 9, 2020.

(51) Int. Cl.
*H01R 13/652* (2006.01)
*H01R 12/75* (2011.01)
(Continued)

(52) U.S. Cl.
CPC ..... *H01R 13/652* (2013.01); *H01R 12/716* (2013.01); *H01R 12/721* (2013.01);
(Continued)

(58) Field of Classification Search
CPC .. H01R 13/405; H01R 13/502; H01R 12/716; H01R 12/721; H01R 12/724; H01R 24/60; H01R 2107/00
(Continued)

(56) References Cited

U.S. PATENT DOCUMENTS 6,296,491 B1 * 10/2001 Pickles ..... H01R 12/7094 439/60
6,672,905 B2 * 1/2004 Tharp ..... H01R 12/721 439/660
(Continued)

FOREIGN PATENT DOCUMENTS

CN 208797211 U * 4/2019 ..... H01R 13/6597

*Primary Examiner* — Peter G Leigh
(74) *Attorney, Agent, or Firm* — Ming Chieh Chang; Wei Te Chung

(57) ABSTRACT

An electrical connector assembly comprising: an insulative housing with a front mating slot and a rear receiving cavity; a combo contact module assembly received within the receiving cavity and including a sideband contact module sandwiched between a pair of high speed contact modules; each high speed contact module including an upper unit and a lower unit assembled with each other in a vertical direction; the upper unit and the lower unit being essentially symmetrically arranged with each other in the vertical direction with a half of pitch offset in a transverse direction; and a metallic shell; wherein each of the upper unit and the lower unit including a front subunit and a rear subunit stacked with each other in the vertical direction and retained together.

9 Claims, 57 Drawing Sheets

(51) Int. Cl.

| | |
|---|---|
| ***H01R 13/6581*** | (2011.01) |
| ***H01R 13/6592*** | (2011.01) |
| ***H01R 13/6594*** | (2011.01) |
| ***H01R 12/71*** | (2011.01) |
| ***H01R 12/72*** | (2011.01) |
| ***H01R 13/405*** | (2006.01) |
| ***H01R 13/502*** | (2006.01) |
| ***H01R 24/60*** | (2011.01) |
| *H01R 107/00* | (2006.01) |

(52) U.S. Cl.
CPC ..... *H01R 12/724* (2013.01); *H01R 12/75* (2013.01); *H01R 13/405* (2013.01); *H01R 13/502* (2013.01); *H01R 13/6581* (2013.01); *H01R 13/6592* (2013.01); *H01R 13/6594* (2013.01); *H01R 24/60* (2013.01); *H01R 2107/00* (2013.01)

(58) Field of Classification Search
USPC ..... 439/736
See application file for complete search history.

(56) References Cited

U.S. PATENT DOCUMENTS 6,719,583 B2 * 4/2004 Tharp ..... H01R 12/721 439/493
7,114,963 B2 * 10/2006 Shuey ..... H01R 12/00 439/79
7,410,392 B2 * 8/2008 Szczesny ..... H01R 13/514 439/607.05
7,607,949 B2 * 10/2009 Hsu ..... H01R 12/716 439/267
7,731,541 B1 * 6/2010 Lee ..... H01R 13/6585 439/660
7,806,730 B2 * 10/2010 Szczesny ..... H01R 43/24 439/637
7,824,224 B2 * 11/2010 Su ..... H01R 12/00 439/629
8,282,421 B2 * 10/2012 Lee ..... H01R 13/514 439/629
8,550,855 B2 * 10/2013 Zhang ..... H01R 13/405 439/636
8,727,793 B2 * 5/2014 Cafiero ..... G02B 6/4201 439/76.1
8,944,830 B2 * 2/2015 Little ..... G02B 6/4292 439/79
9,065,225 B2 * 6/2015 Degner ..... H01R 12/737
9,509,101 B2 * 11/2016 Cartier, Jr. ..... H01R 13/6585
9,793,633 B2 * 10/2017 Liao ..... H01R 12/721
9,806,466 B2 * 10/2017 Liao ..... H01R 13/6586
9,935,385 B2 * 4/2018 Phillips ..... H01R 13/26
10,069,262 B2 * 9/2018 Little ..... H01R 12/724
10,320,102 B2 * 6/2019 Phillips ..... H01R 12/716
10,490,920 B2 * 11/2019 Manickam ..... H01R 13/648
10,559,930 B2 2/2020 Foxconn
10,756,489 B2 * 8/2020 Hu ..... H01R 12/737
2003/0186580 A1 * 10/2003 Dambach ..... H01R 13/6273 439/497
2017/0077632 A1 * 3/2017 Liao ..... H01R 13/405
2018/0115119 A1 * 4/2018 Little ..... H01R 12/712
2019/0131743 A1 * 5/2019 Hsu ..... H01R 13/405
2020/0076131 A1 * 3/2020 Hu ..... H01R 13/6597

* cited by examiner

ELECTRICAL CONNECTOR ASSEMBLY WITH HIGH SPEED HIGH DENSITY SYMMETRICAL CONTACT ARRANGEMENT

BACKGROUND OF THE INVENTION

1. Field of the Invention

The present invention relates generally to an electrical connector assembly with the high speed module and the sideband module thereof, and particularly to the high speed module equipped with the grounding bar and directly attached to the cable. The instant application is related to another copending application with the same filing date, the same applicant and the same title.

2. Description of Related Arts

U.S. Pat. No. 10,559,930 discloses an electrical connector having the high speed contacts and the sideband contacts arrangement in two rows. U.S. Pat. No. 10,069,262 discloses an electrical connector with the double density contact arrangement. U.S. provisional application Ser. No. 63/004,068 discloses how to make the high speed contact arrangement via a single contact carrier.

It is desired to have the electrical connector with the combo features of the aforementioned three type connectors.

SUMMARY OF THE INVENTION

To achieve the above object, an electrical connector assembly includes an insulative housing with a front mating slot and a rear receiving cavity; a combo contact module assembly received within the receiving cavity and including a sideband contact module sandwiched between a pair of high speed contact modules; a combo contact module assembly received within the receiving cavity and including a sideband contact module sandwiched between a pair of high speed contact modules; each high speed contact module including an upper unit and a lower unit assembled with each other in the vertical direction; the upper unit and the lower unit being essentially symmetrical arranged with each other in the vertical direction; and a metallic shell; wherein each of the upper unit and the lower unit including a front subunit and a rear subunit stacked with each other in the vertical direction and retained together by the metallic shell.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
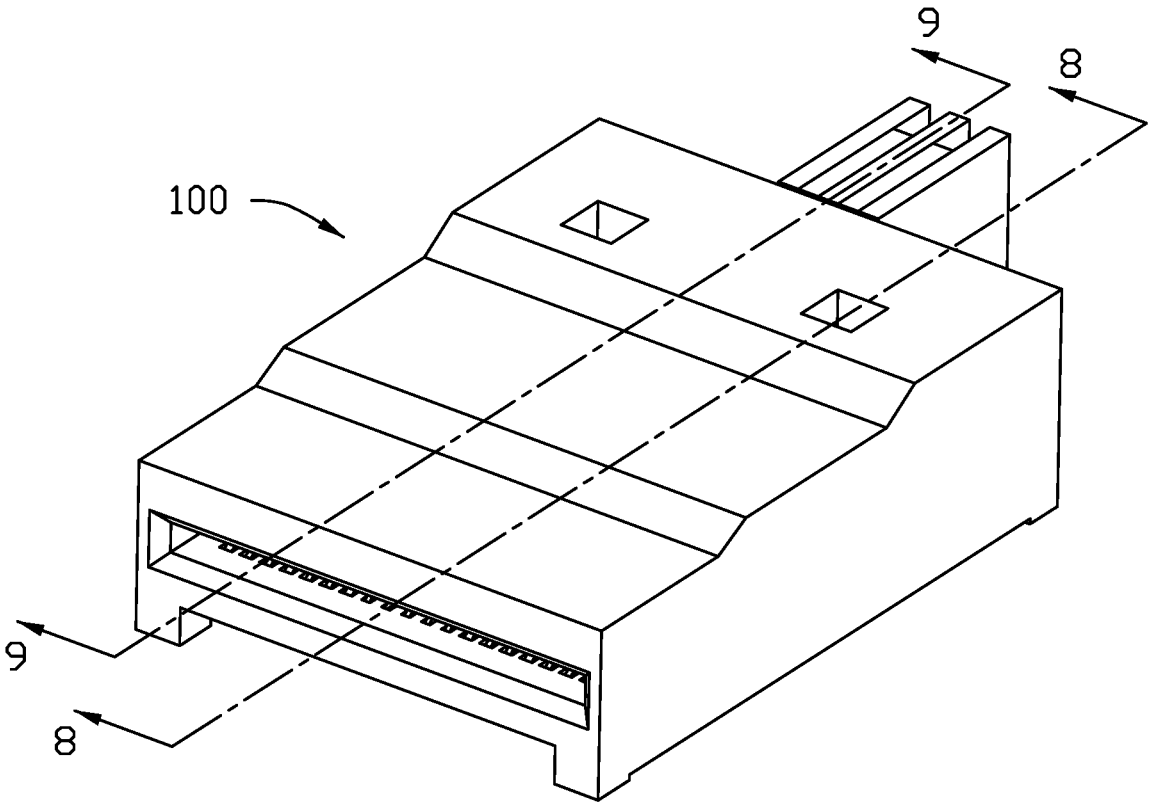
FIG. 1 is a perspective view of the electrical connector assembly according to a preferred embodiment of the present invention.
Figure 2:
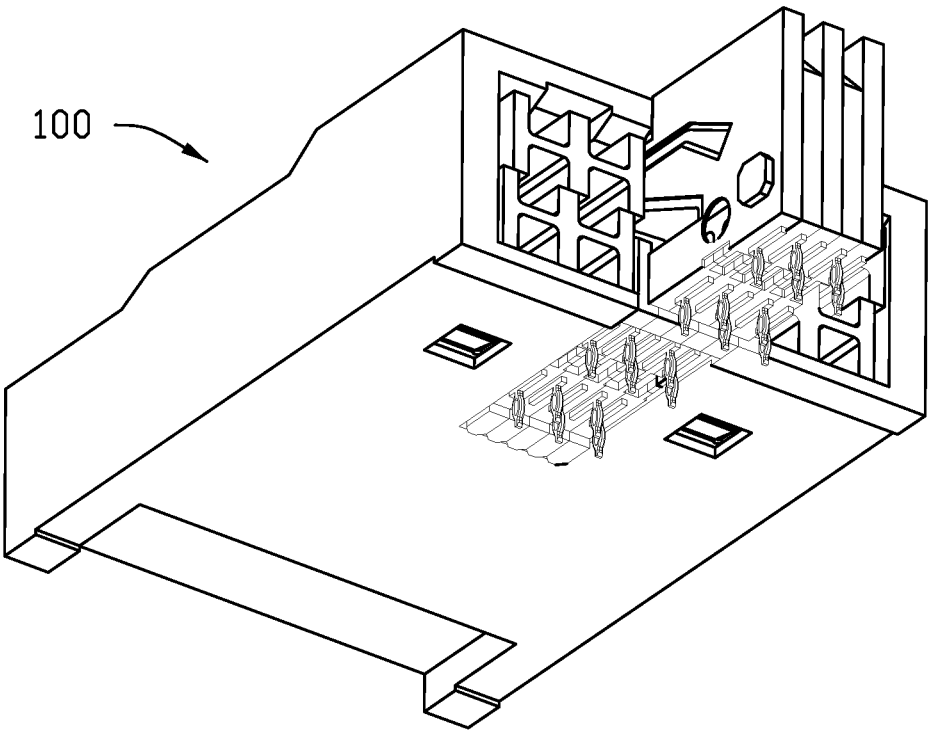
FIG. 2 is another perspective view of the electrical connector assembly of FIG. 1.
Figure 3:
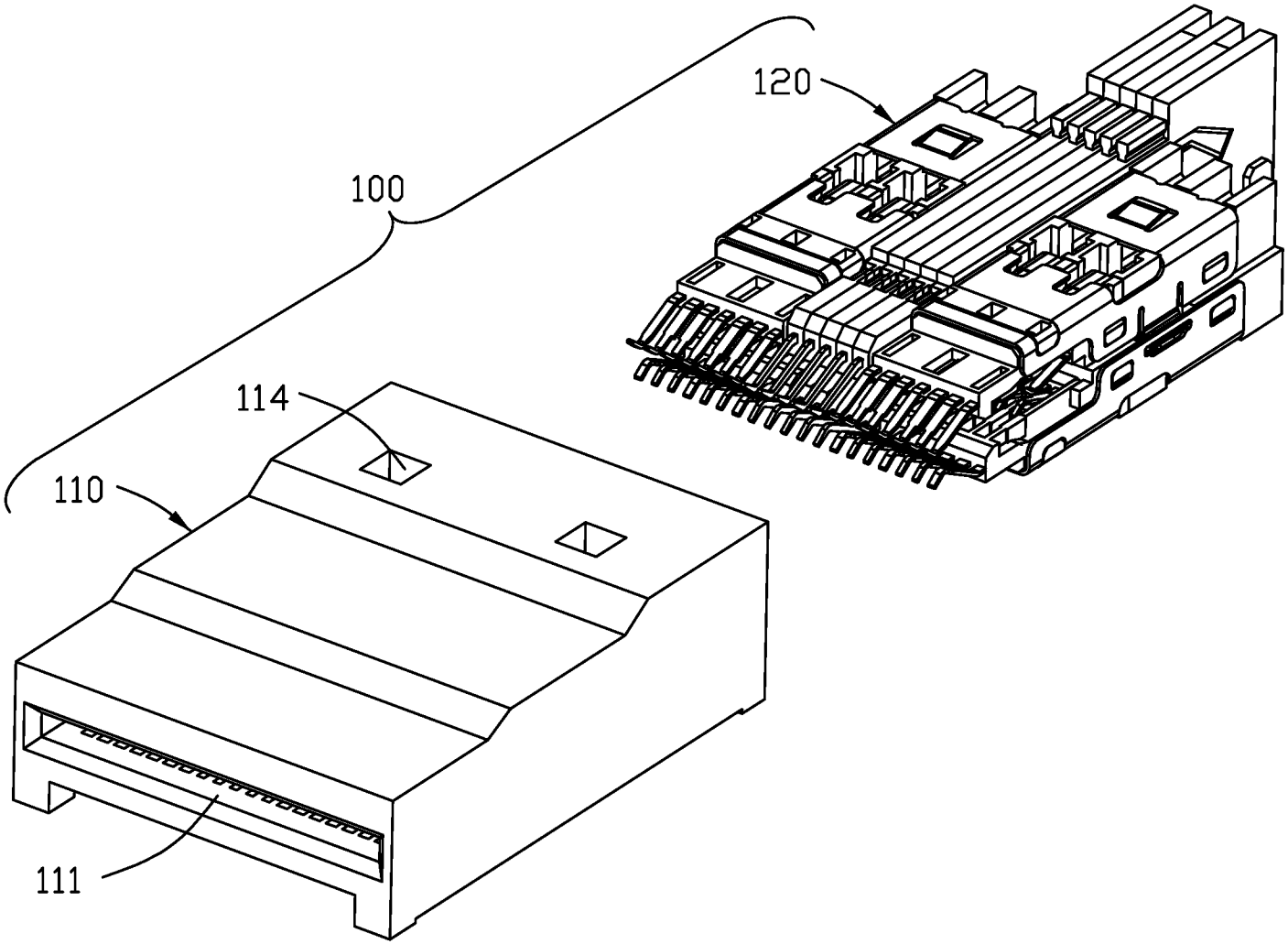
FIG. 3 is an exploded perspective view of the electrical connector assembly of FIG. 1.
Figure 4:
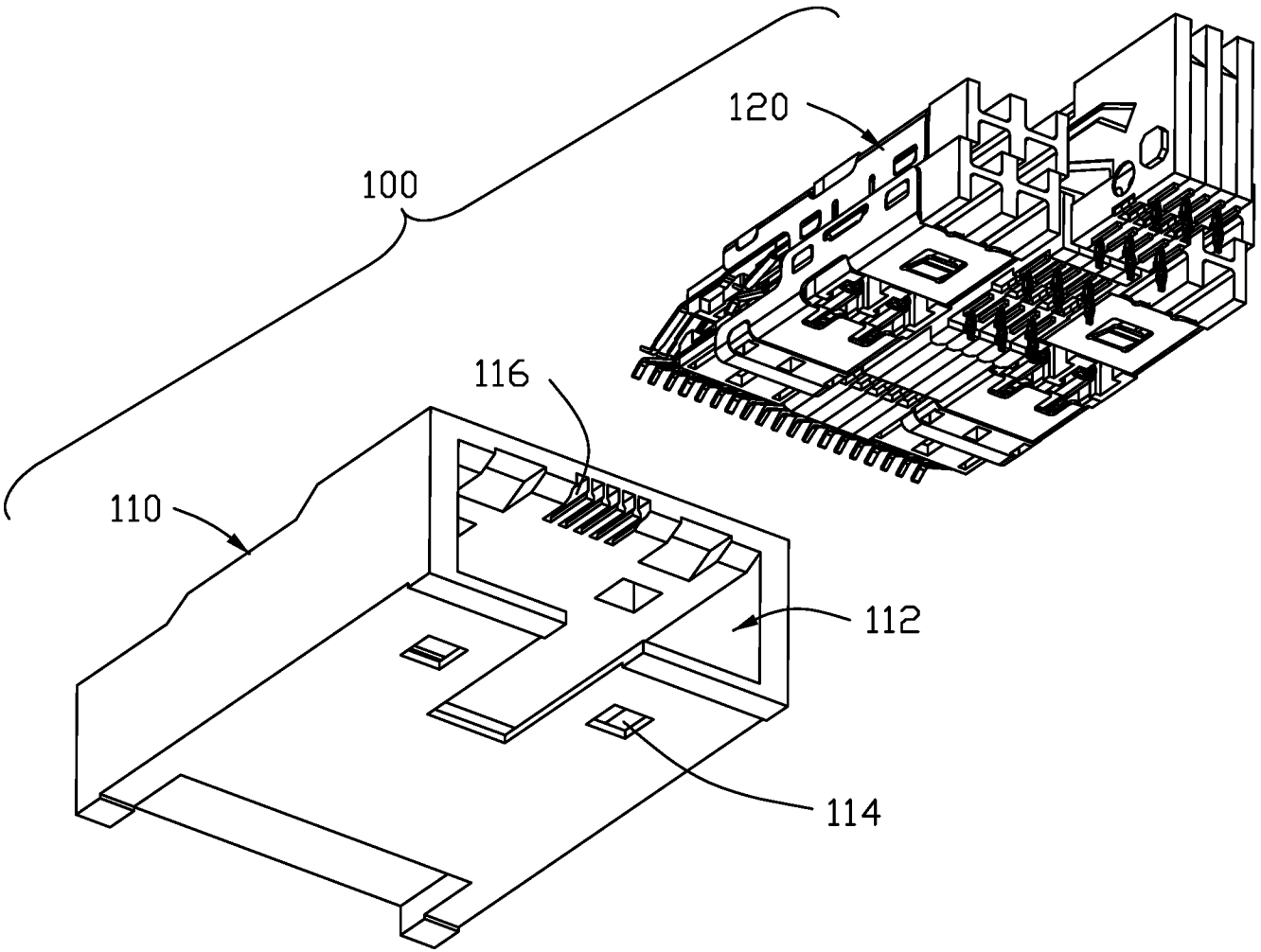
FIG. 4 is another exploded perspective view of the electrical connector assembly of FIG. 3.
Figure 5:
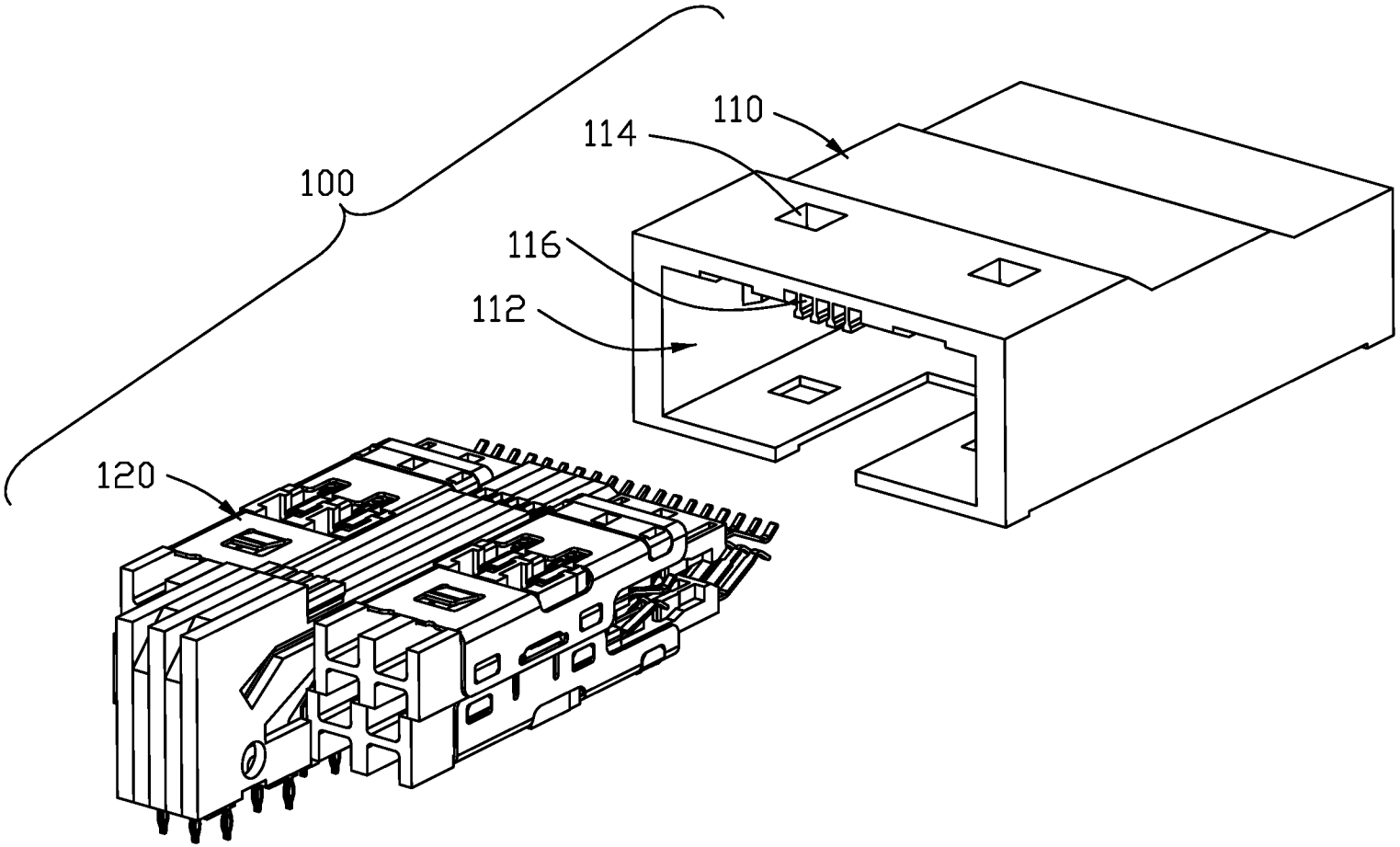
FIG. 5 is another exploded perspective view of the electrical connector assembly of FIG. 3.
Figure 6:
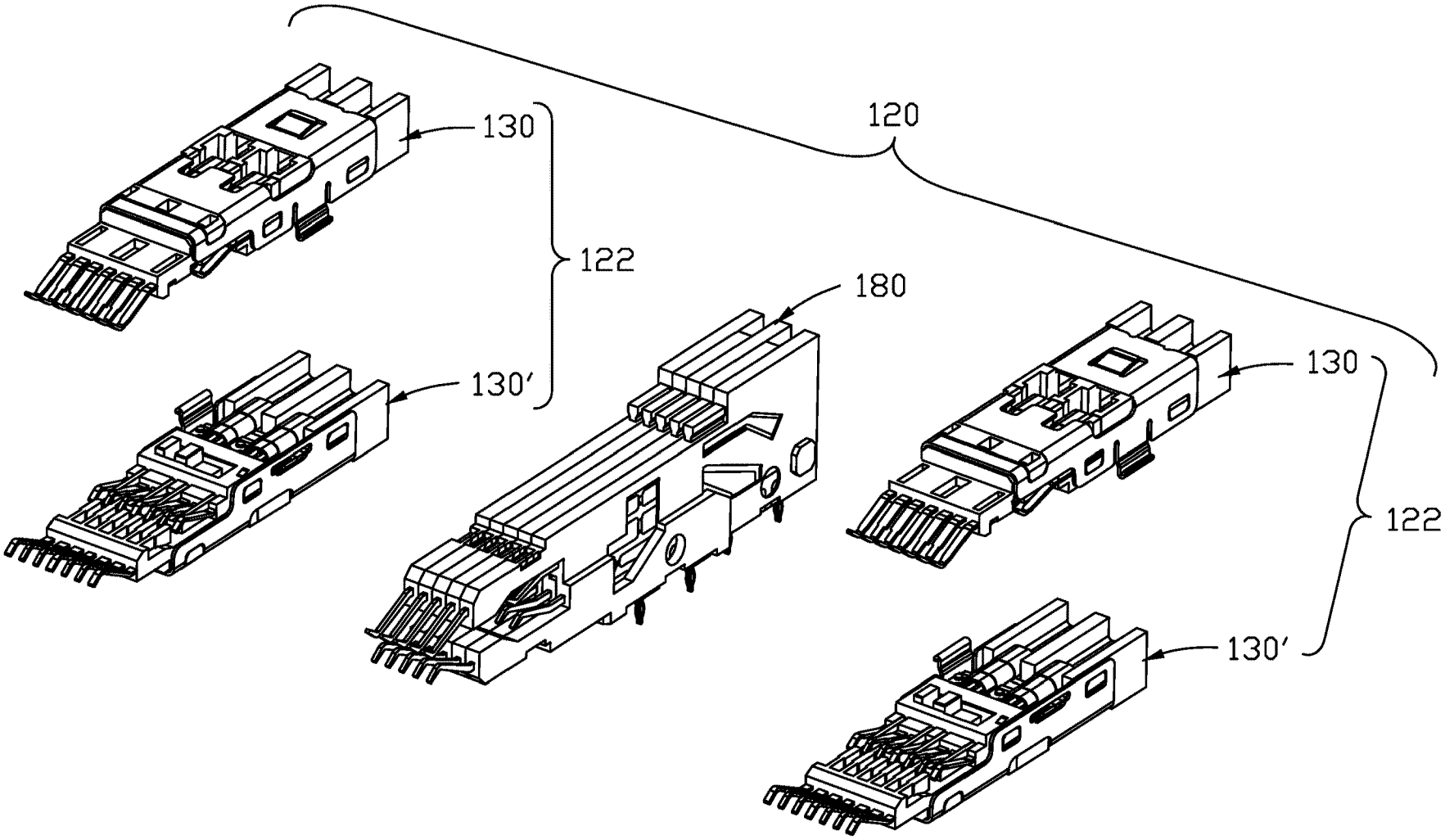
FIG. 6 is an exploded perspective view of the contact module assembly of the electrical connector assembly of FIG. 1.
Figure 7:
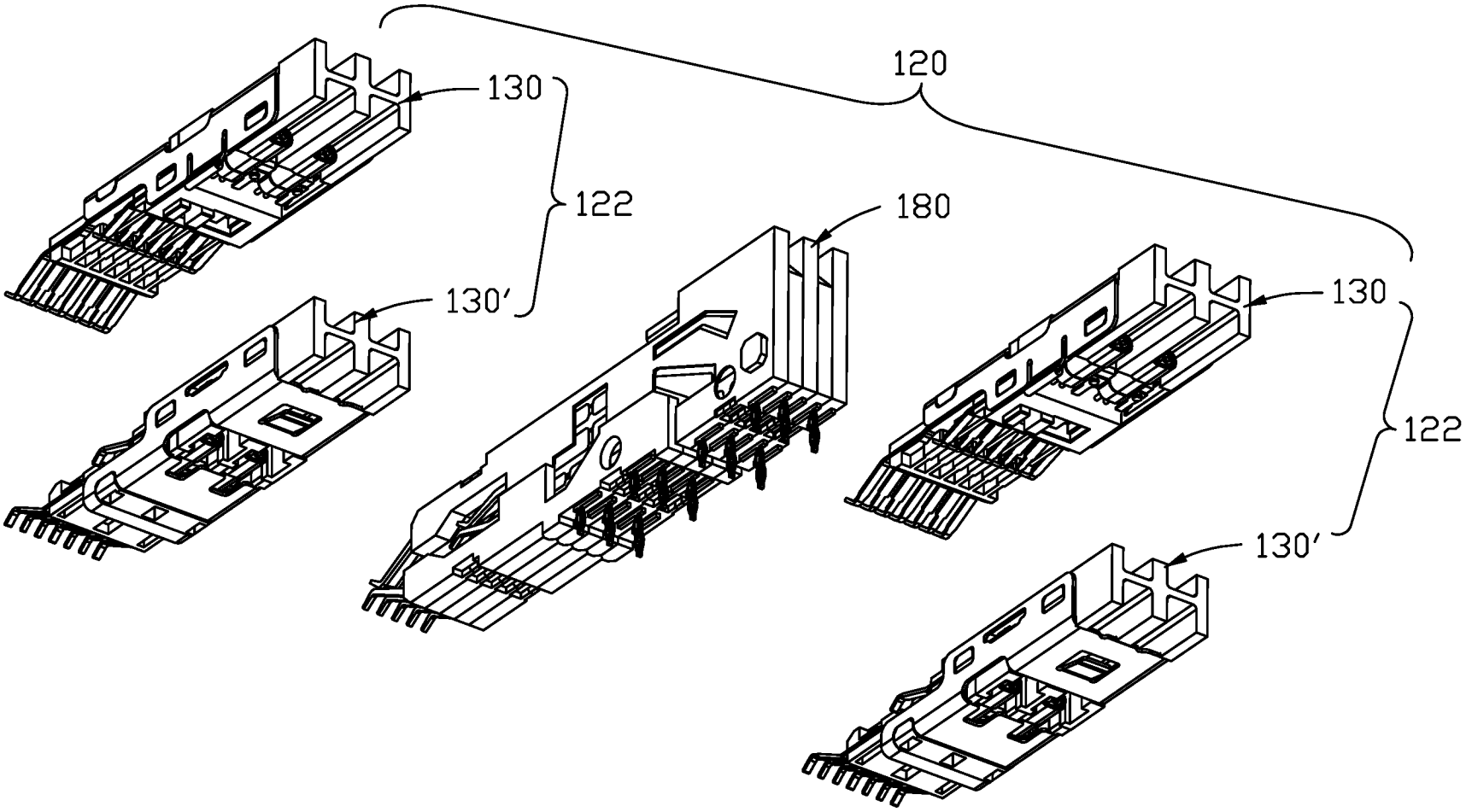
FIG. 7 is another exploded perspective view of the contact module assembly of the electrical connector assembly of FIG. 6.
Figure 8:
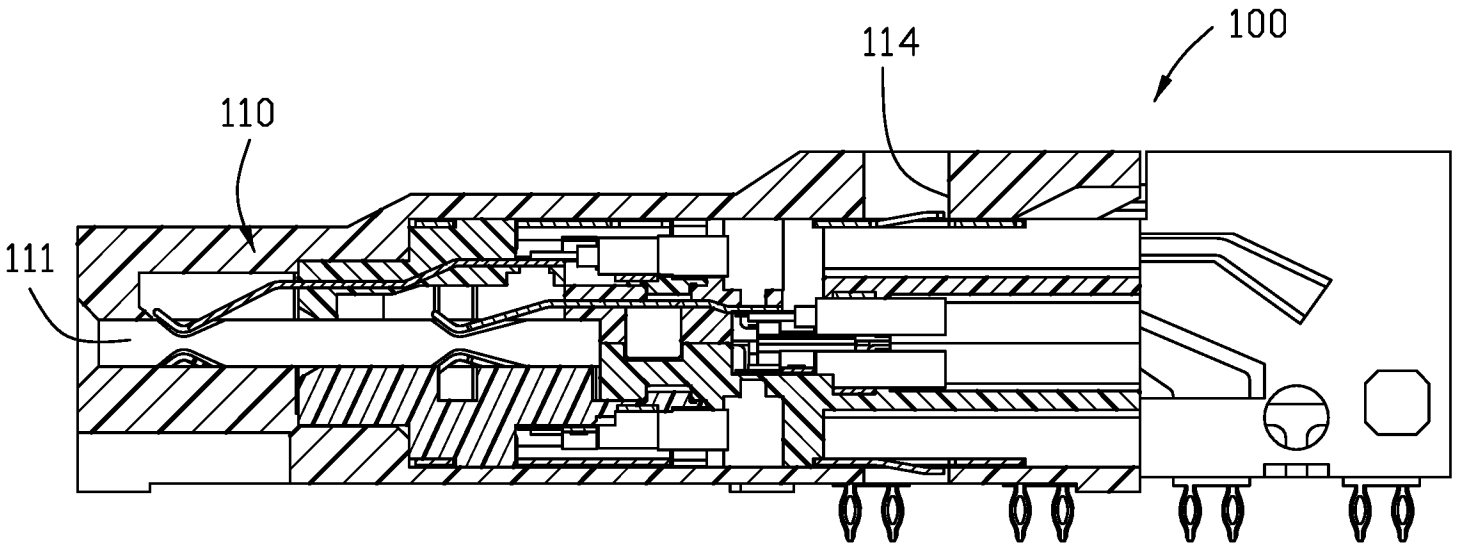
FIG. 8 is a cross-sectional view along line 8-8 of the electrical connector assembly of FIG. 1.
Figure 9:
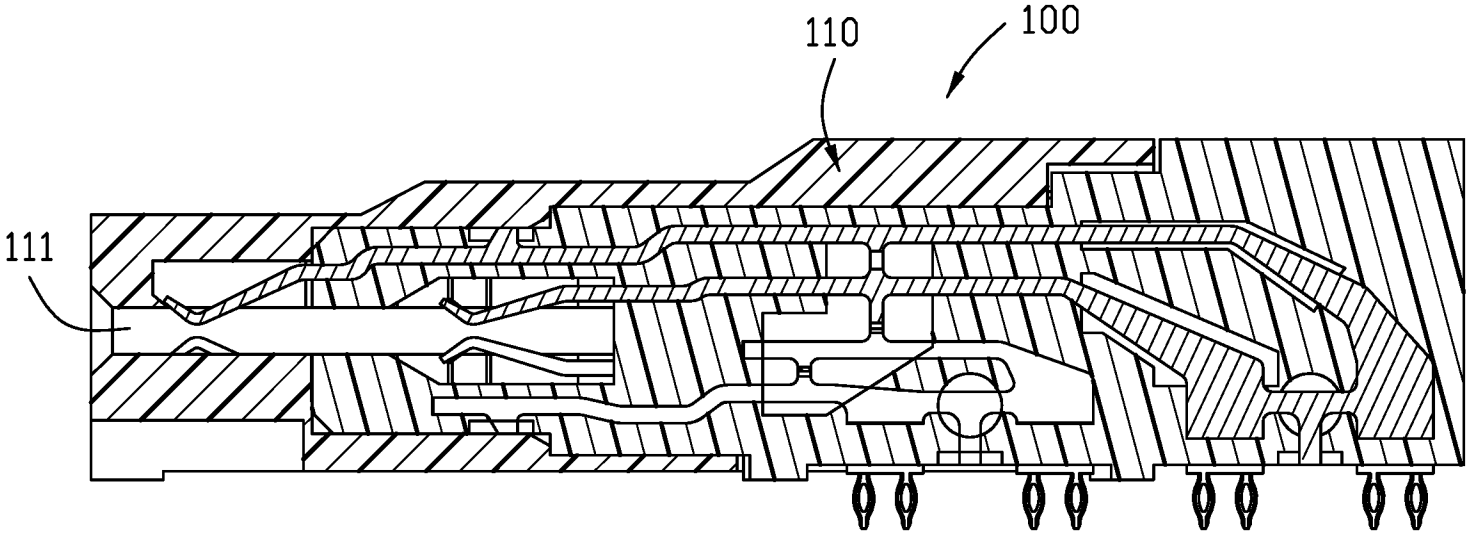
FIG. 9 is another cross-sectional view along line 9-9 of the electrical connector assembly of FIG. 8.
Figure 10:
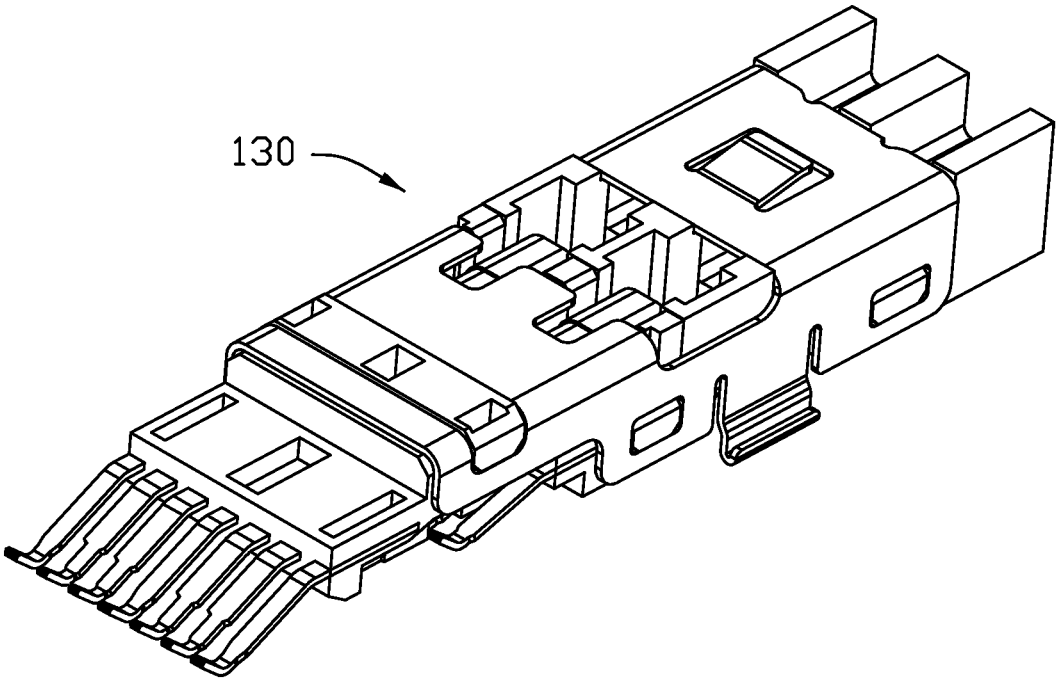
FIG. 10 is a perspective view of the upper unit of the high speed contact module of the electrical connector assembly of FIG. 6.
Figure 11:
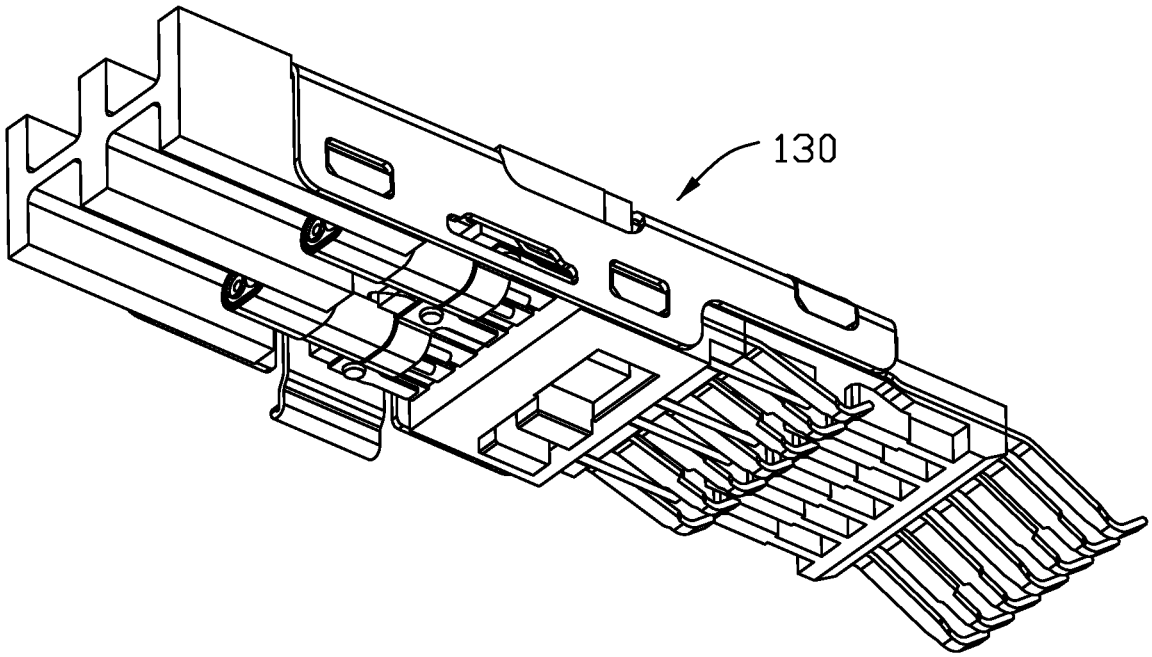
FIG. 11 is another perspective view of the upper unit of the high speed contact module of the electrical connector assembly of FIG. 10.
Figure 12:
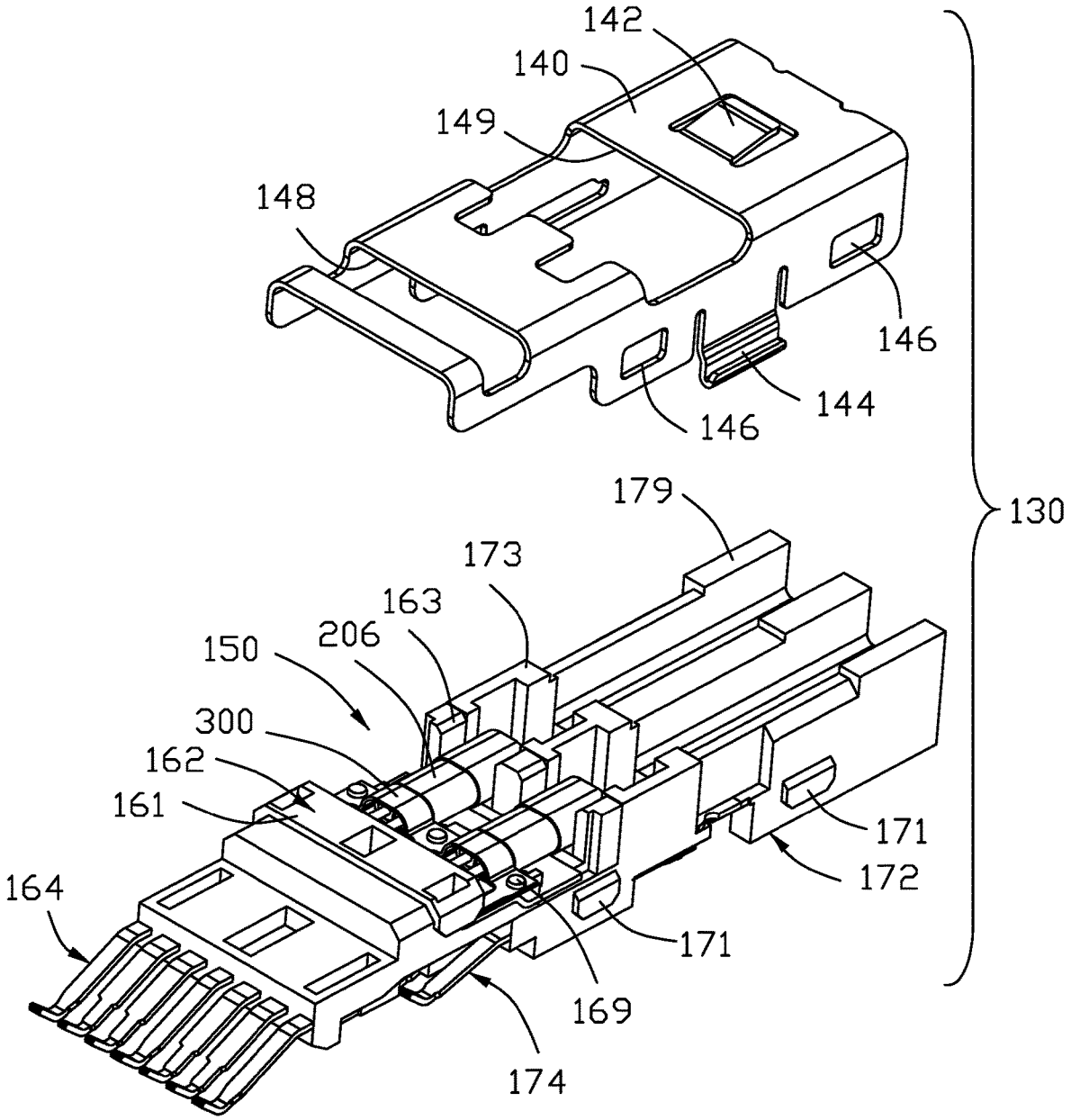
FIG. 12 is an explode perspective view of the upper unit of the high speed contact module of the electrical connector assembly of FIG. 10.
Figure 13:
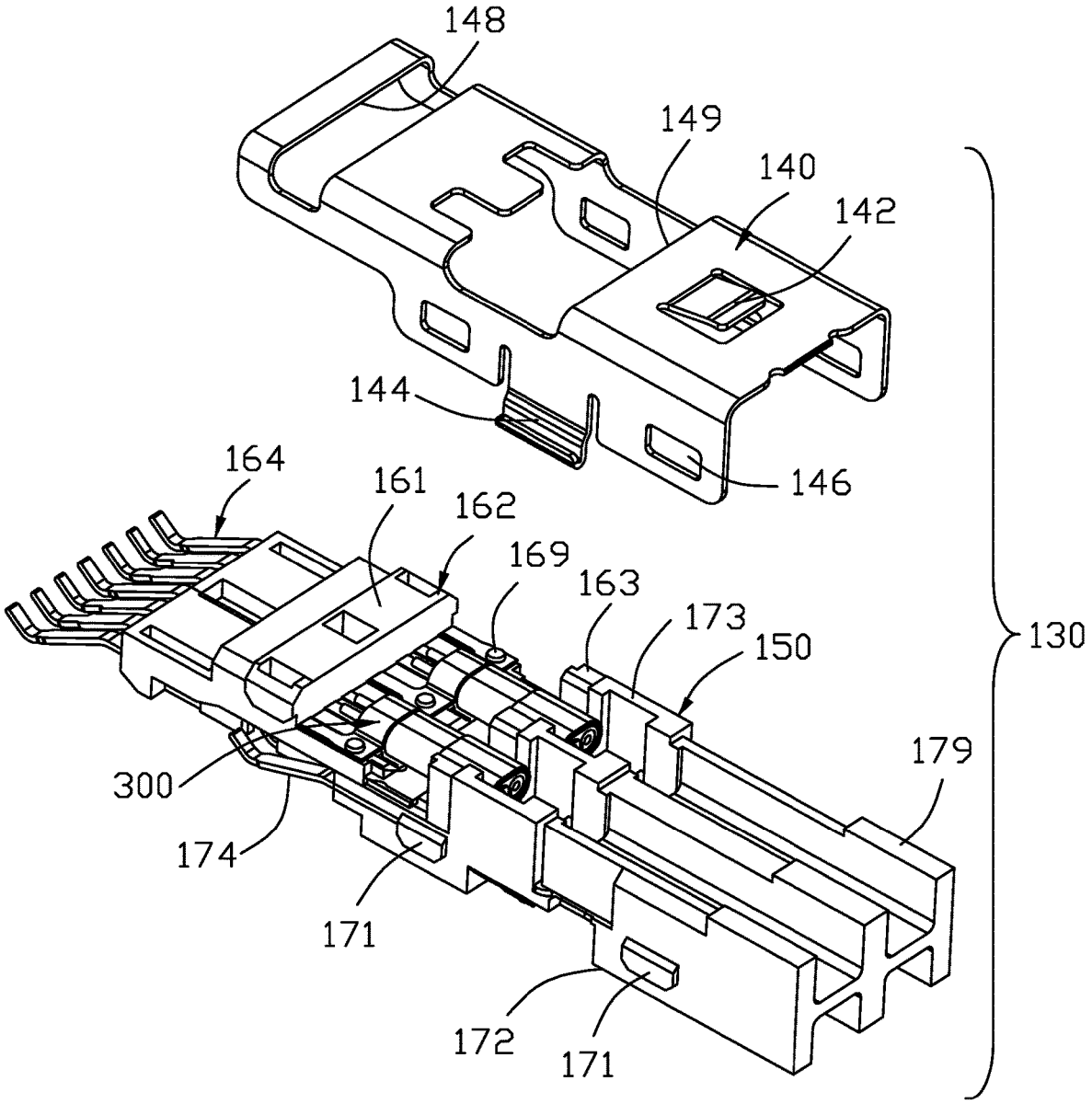
FIG. 13 is another exploded perspective view of the upper unit of the high speed contact module of the electrical connector assembly of FIG. 12.
Figure 14:
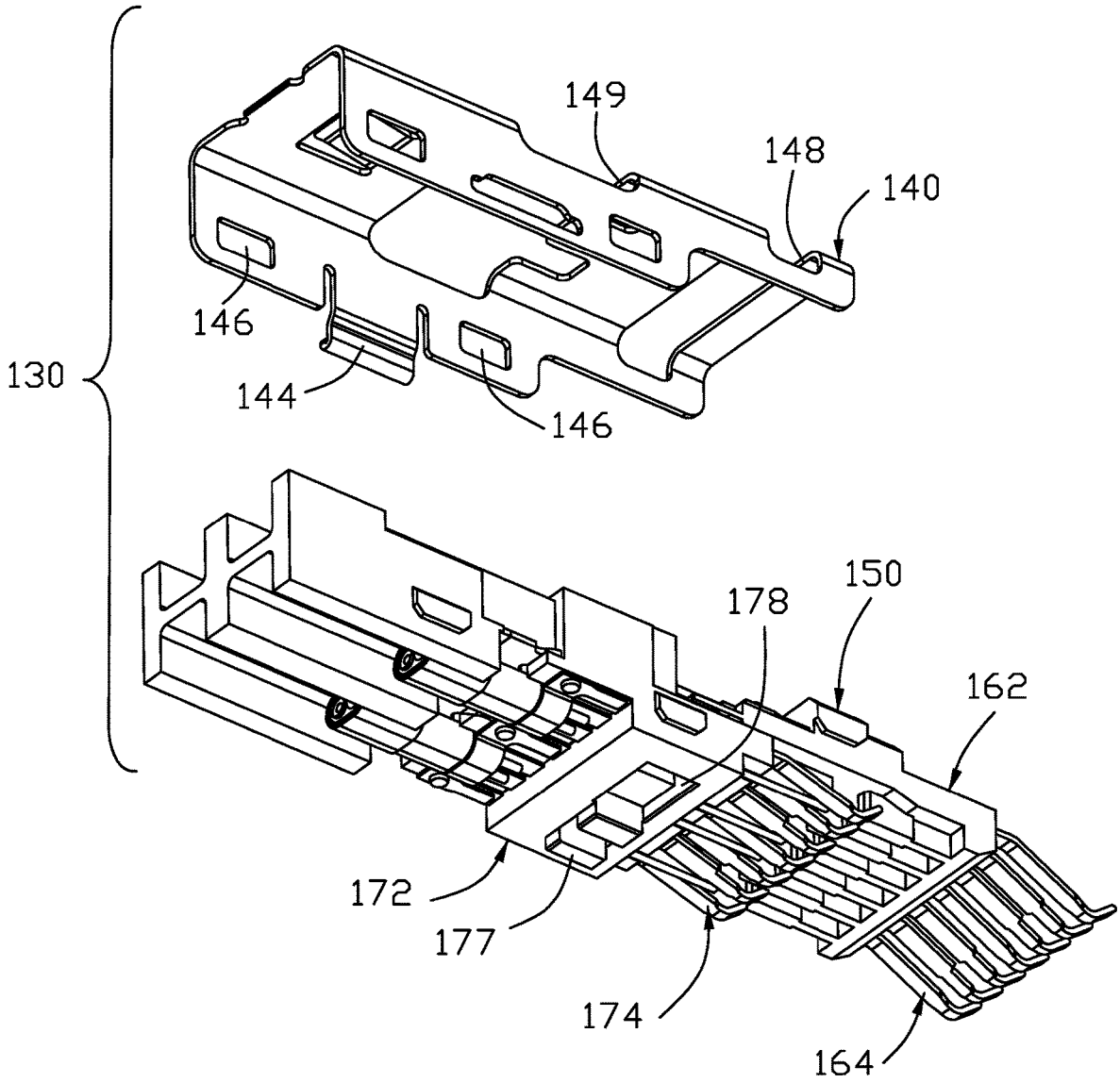
FIG. 14 is another exploded perspective view of the upper unit of the high speed contact module of the electrical connector assembly of FIG. 12.
Figure 15:
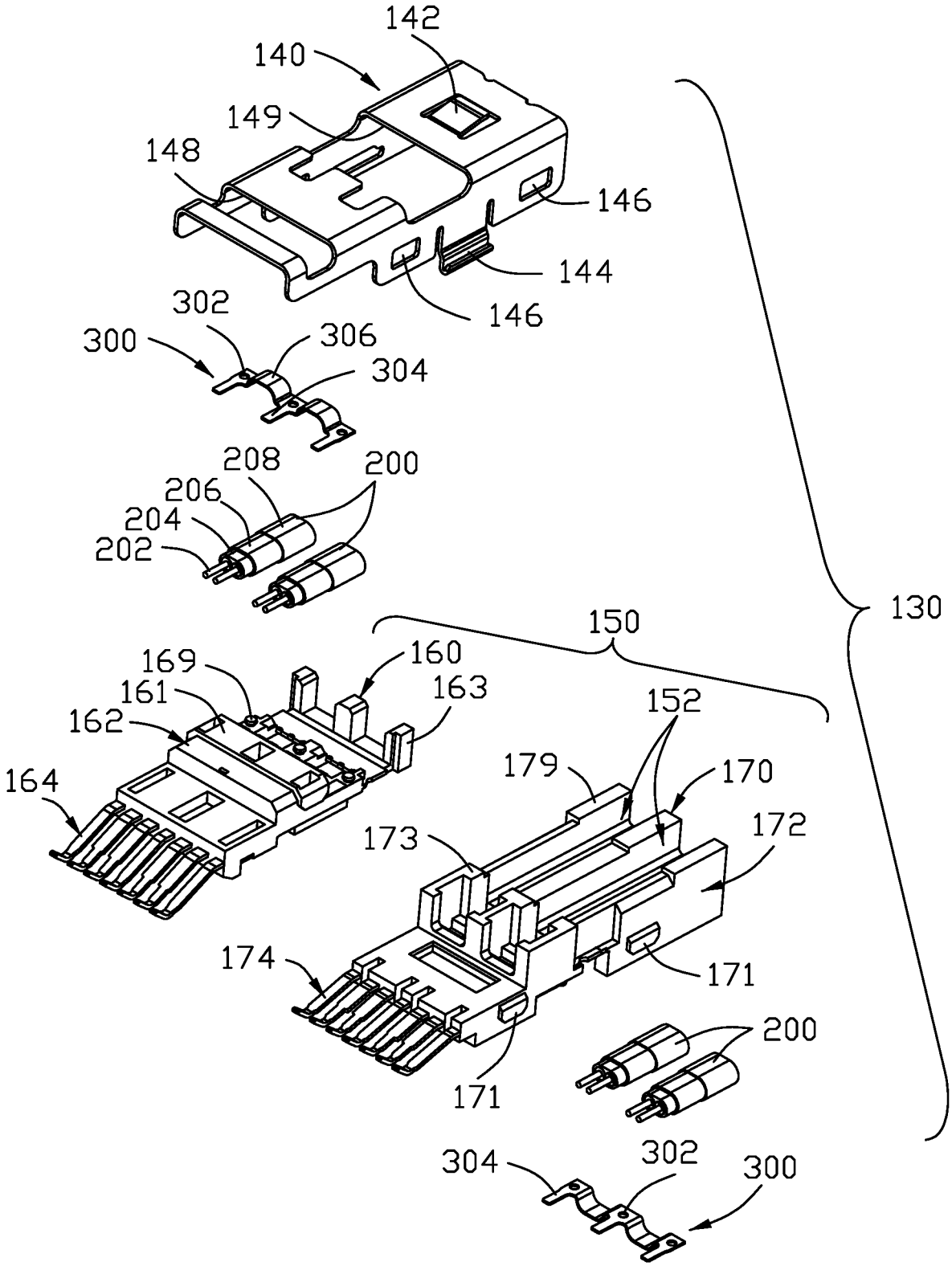
FIG. 15 is a further exploded perspective view of the upper unit of the high speed contact module of the electrical connector assembly of FIG. 12.

Referring to FIGS. 1-23, an electrical connector assembly 100 includes an insulative housing 110 enclosing therein a contact module assembly 120 which includes a sideband contact module 180 sandwiched between a pair of high speed contact modules 122. The housing 110 forms a front mating slot 111 and a rear receiving cavity 112. A plurality of guiding grooves 116 are formed at a rear end of the housing 110 for cooperation with the sideband contact module 180 of the contact module assembly 120, and a plurality of securing apertures 114 are formed in the upper and bottom walls of the housing 110 for cooperation with the high speed contact modules 122 of the contact module assembly 120. A cutout (not labeled) is formed in the bottom wall of the housing 110 for allowing contact tail extension toward the printed circuit board (not shown) on which the housing 110 is mounted.

Each high speed contact module 122 includes an upper unit 130 and a lower unit 130' stacked with each other in the vertical direction wherein the upper unit 130 and the lower unit 130' are structurally similar/identical to each other and arranged in an essentially symmetrical manner in the vertical direction, thus saving the manufacturing cost on the mold designs. In detail, the contacts of the upper unit 130 and the contacts of the lower unit 130' are offset from each other with one half of pitch in the transverse direction for complying with the industry standard shown in FIGS. 8 and 9. Based upon the similarity and identicality between the upper unit 130 and the lower unit 130', only the upper unit 130 is described in detail.

The upper unit 130 includes a front/outer contact subunit 160 and a rear/inner contact subunit 170 assembled together as a contact unit 150 by a metallic shell 140. The front/outer contact subunit 160 includes a plurality of contacts 164 integrally formed within a front/outer insulator 162 via insert-molding, and the rear/inner contact subunit 170 includes a plurality of contacts 174 integrally formed with a rear/inner insulator 172 via insert-molding. The contacts 164 includes two pairs of differential pair contacts 166 alternately arranged with three grounding contacts 165 in the transverse direction wherein the tails of the grounding contacts 165 are linked together with a transverse bar (not labeled). The manufacturing of the contacts 164 can be referred to the aforementioned U.S. provisional application Ser. No. 63/004,068.

The front/outer insulator 162 forms a front protrusion 161 and three rear protrusions 163 so as to be received within the front opening 148 and the rear opening 149 of the metallic shell 140. Three deformable posts 169 are formed on the front/outer insulator 162 for cooperation with the grounding bar (300) (illustrated later). A plurality of receiving grooves 167 are formed in an underside of the front/outer insulator 162 for receiving the contacting sections of the corresponding contacts 174 of the rear/inner contact subunit 170.

Correspondingly, the contacts 174 include two pairs of differential pair contacts 176 alternately arranged with three grounding contacts 175 wherein the tails of the grounding contacts 175 are linked together via a transverse bar (not labeled). The rear/inner insulator 172 forms a plurality of front protrusions 173 and a plurality of rear protrusions 179 wherein the front protrusions 173 cooperating with the corresponding rear protrusions 163 to be commonly received within the opening 149 of the shell 140, and the rear edge of the shell 140 abuts against the rear protrusions 179.

Figure 16:
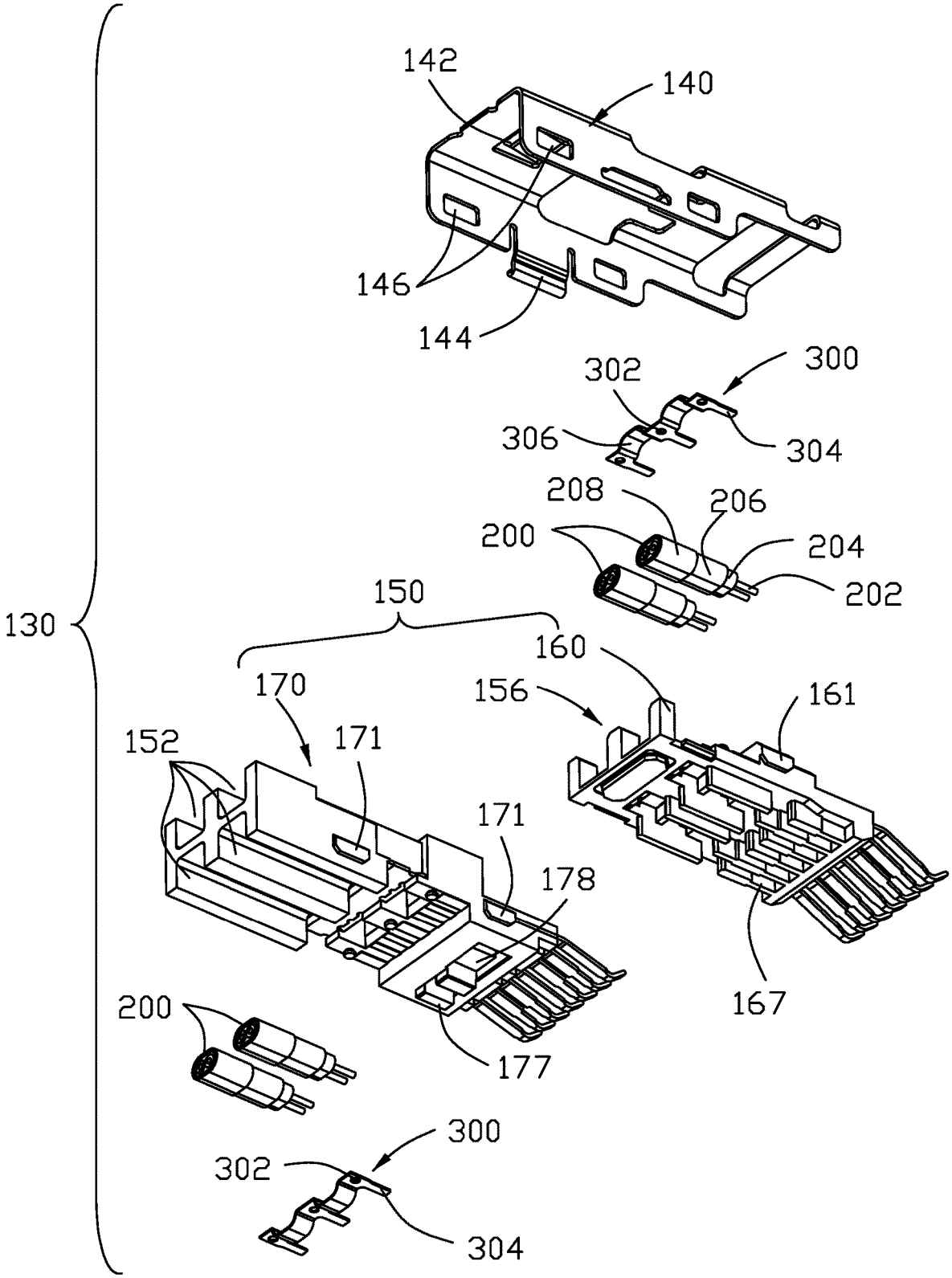
FIG. 16 is an exploded perspective view of the upper unit of the high speed contact module of the electrical connector assembly of FIG. 15.
Figure 17:
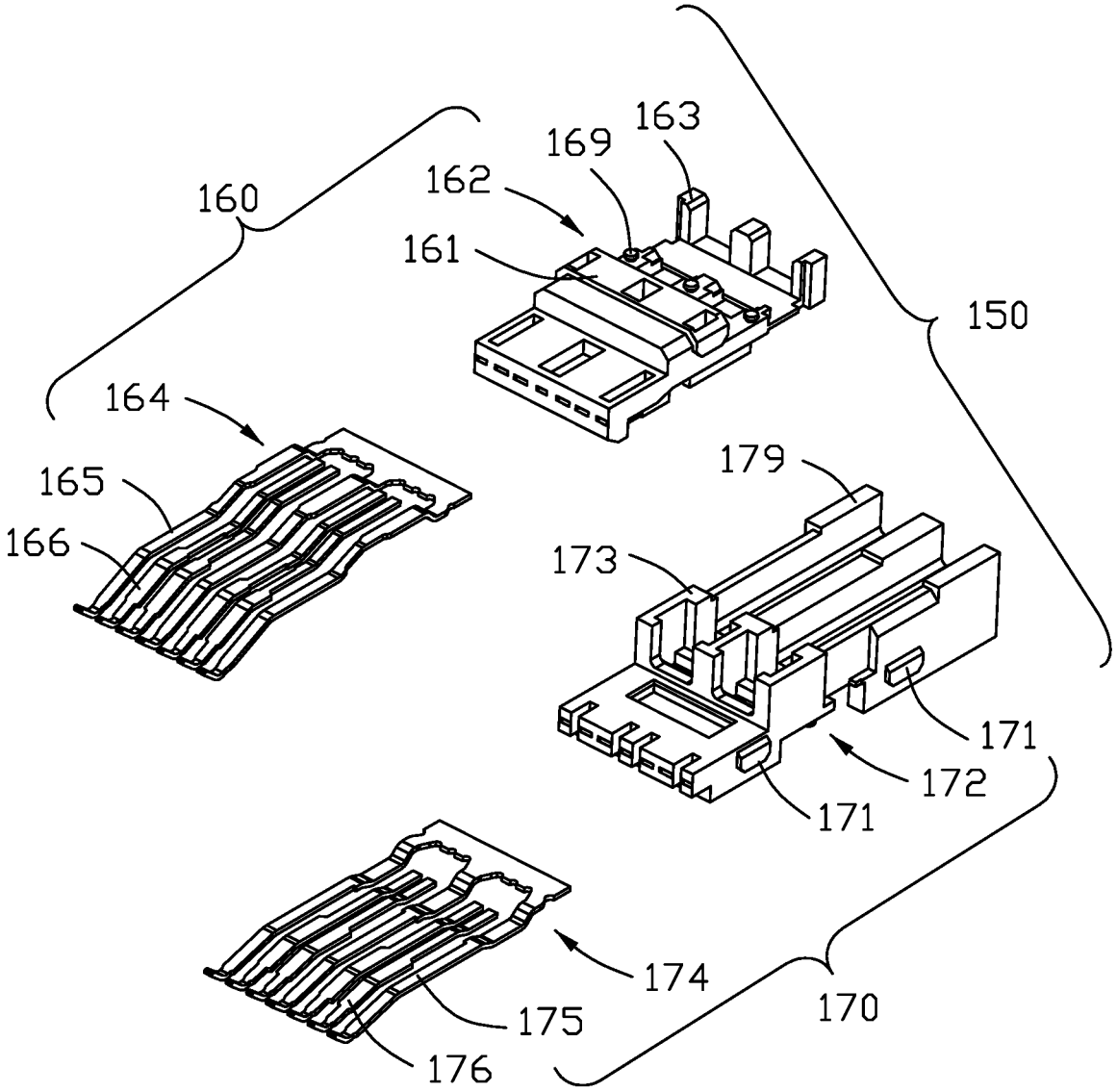
FIG. 17 is a further exploded perspective view of the upper unit of the high speed contact module of the electrical connector assembly.
Figure 18:
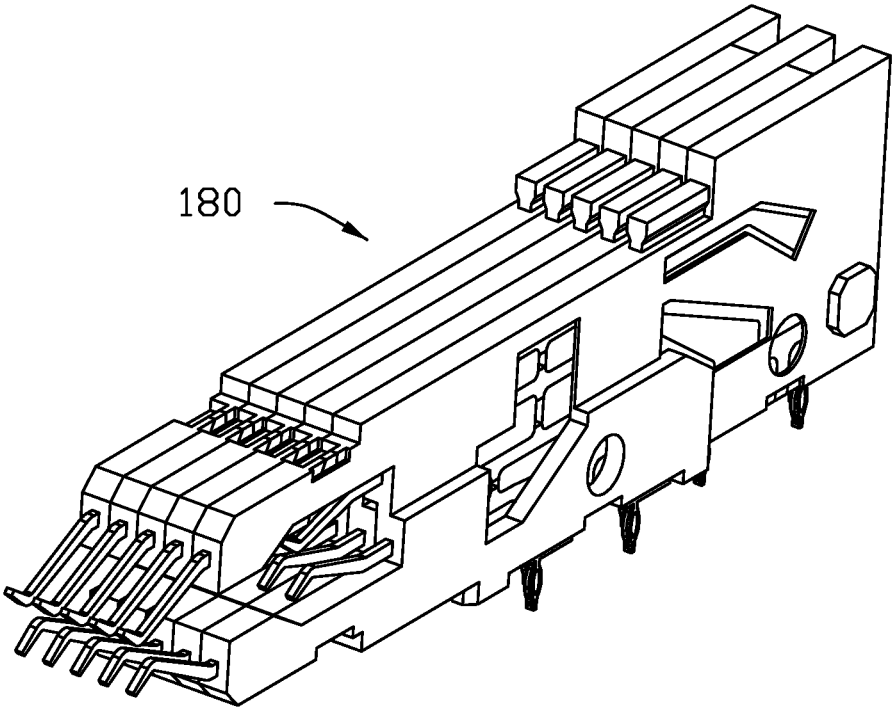
FIG. 18 is a perspective view of the sideband contact module of the contact module assembly of the electrical connector assembly of FIG. 6.
Figure 19:
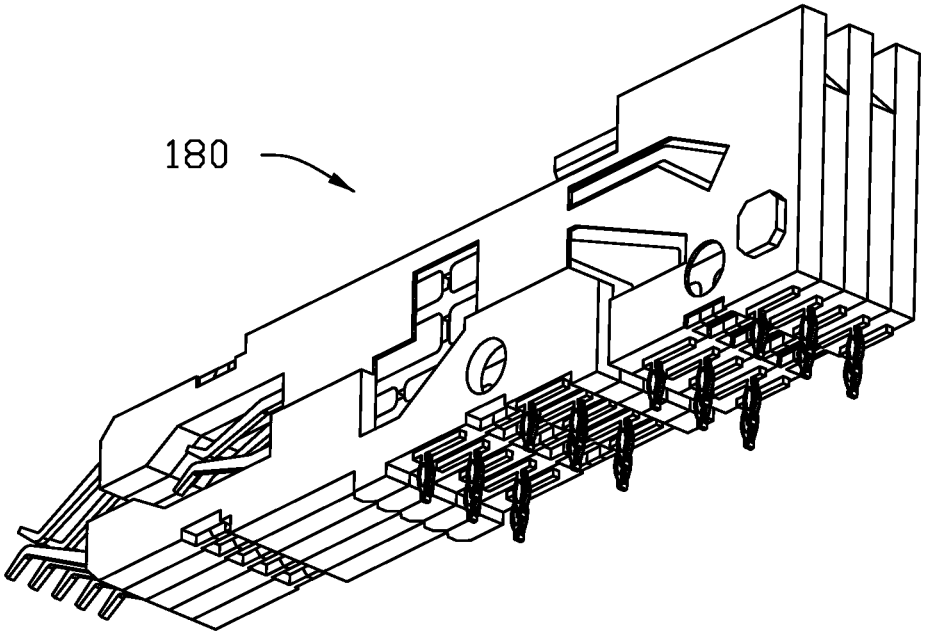
FIG. 19 is another perspective view of the sideband contact module of the contact module assembly of the electrical connector assembly of FIG. 18.
Figure 20:
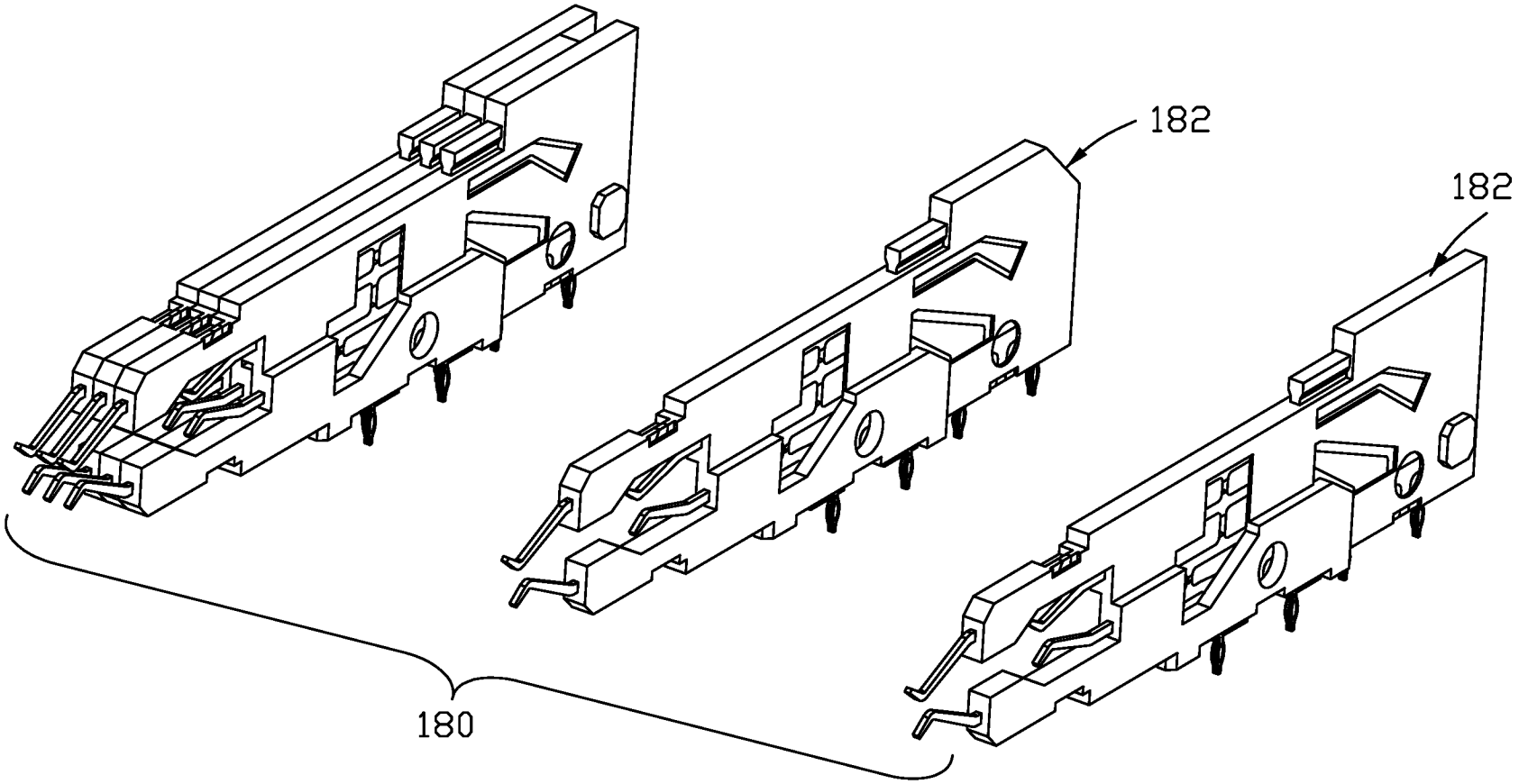
FIG. 20 is an exploded perspective view of the sideband contact module of the contact module assembly of the electrical connector assembly of FIG. 18.
Figure 21:
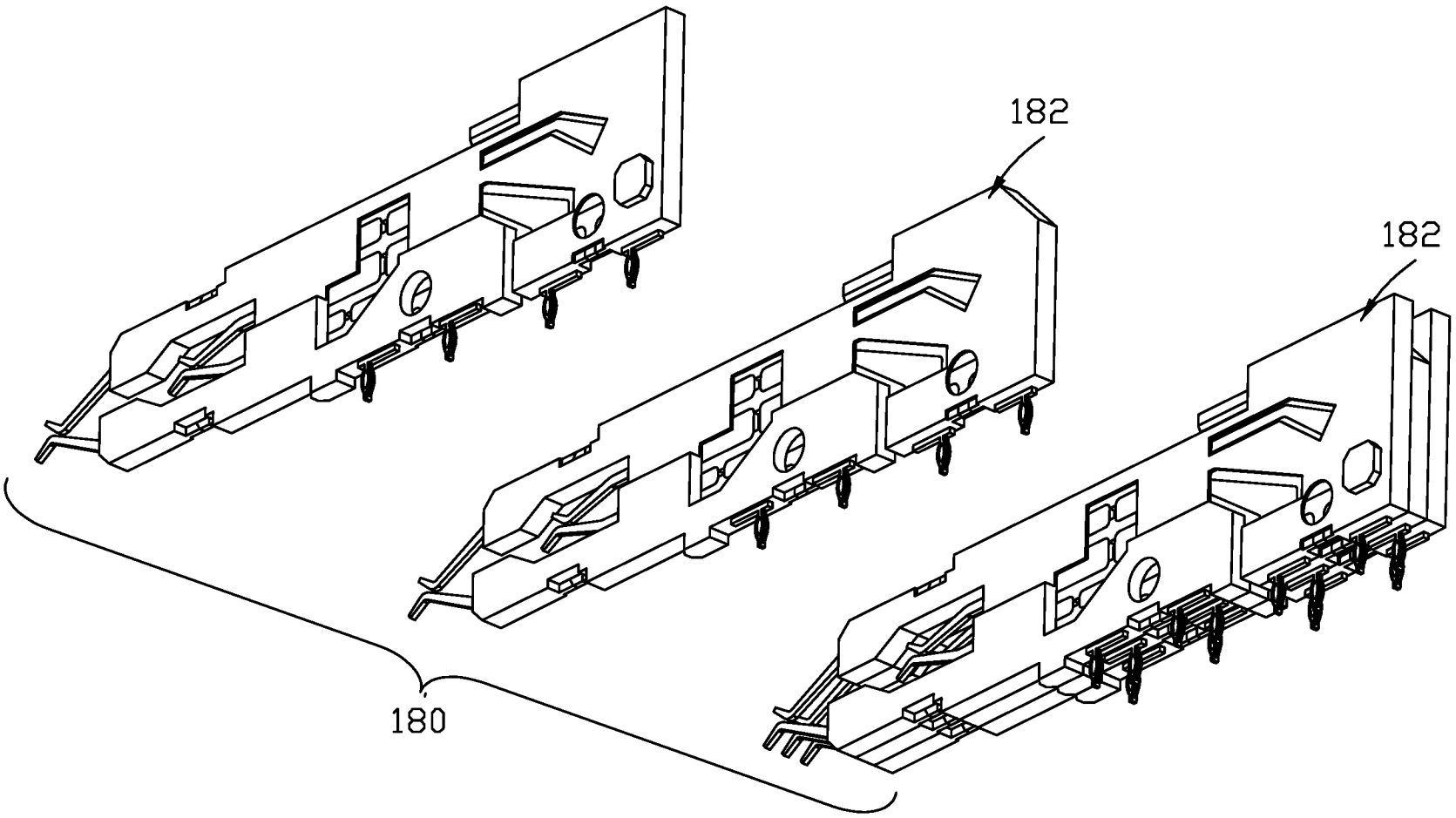
FIG. 21 is another exploded perspective view of the sideband contact module of the contact module assembly of the electrical connector assembly of FIG. 20.
Figure 22:
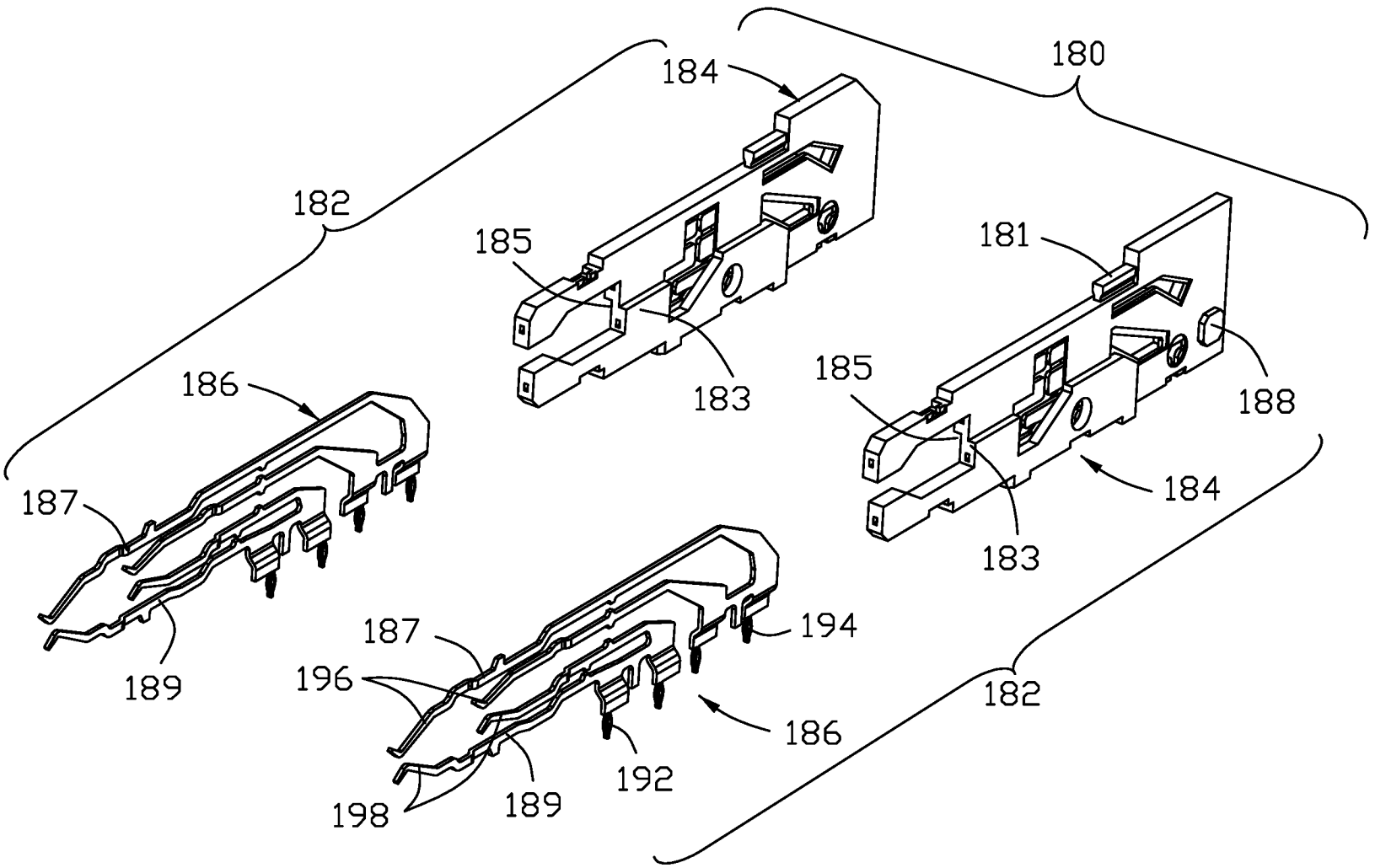
FIG. 22 is a further exploded perspective view of the wafers of the sideband contact module of the contact module assembly of the electrical connector assembly of FIG. 20.
Figure 23:
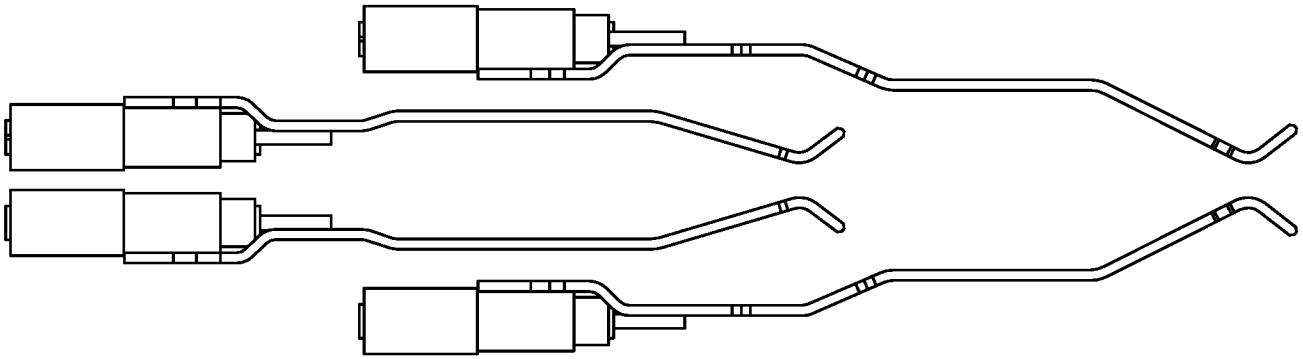
FIG. 23 is a side view of the contacts of the high speed contact module and the corresponding cables of the electrical connector assembly of FIG. 1.
Figure 24:
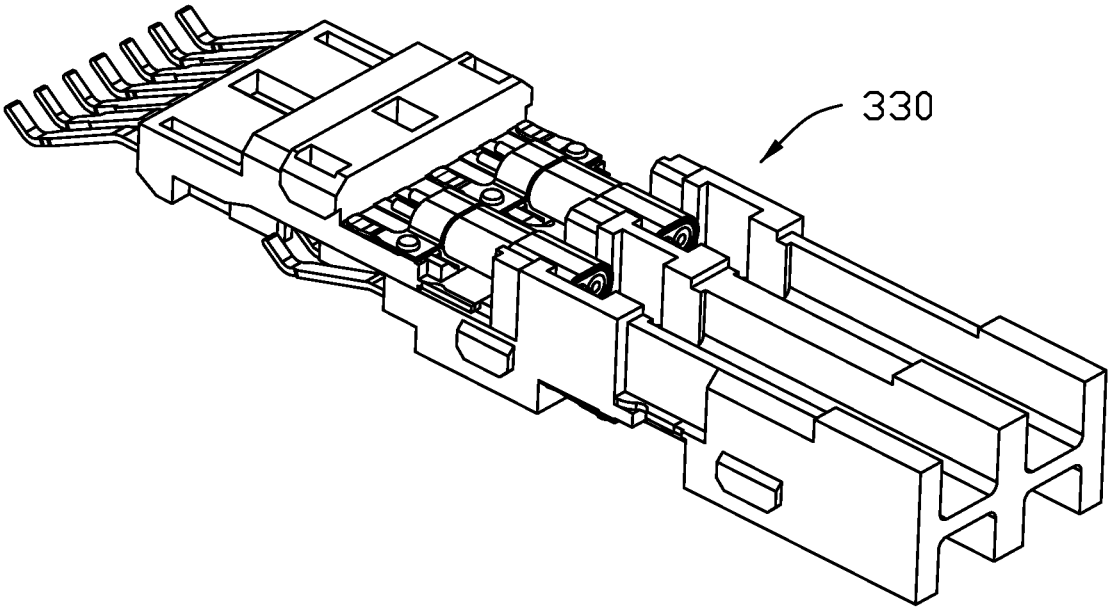
FIG. 24 is a perspective view of the upper unit of the high speed contact module of the electrical connector assembly according to another embodiment of the invention.
Figure 25:
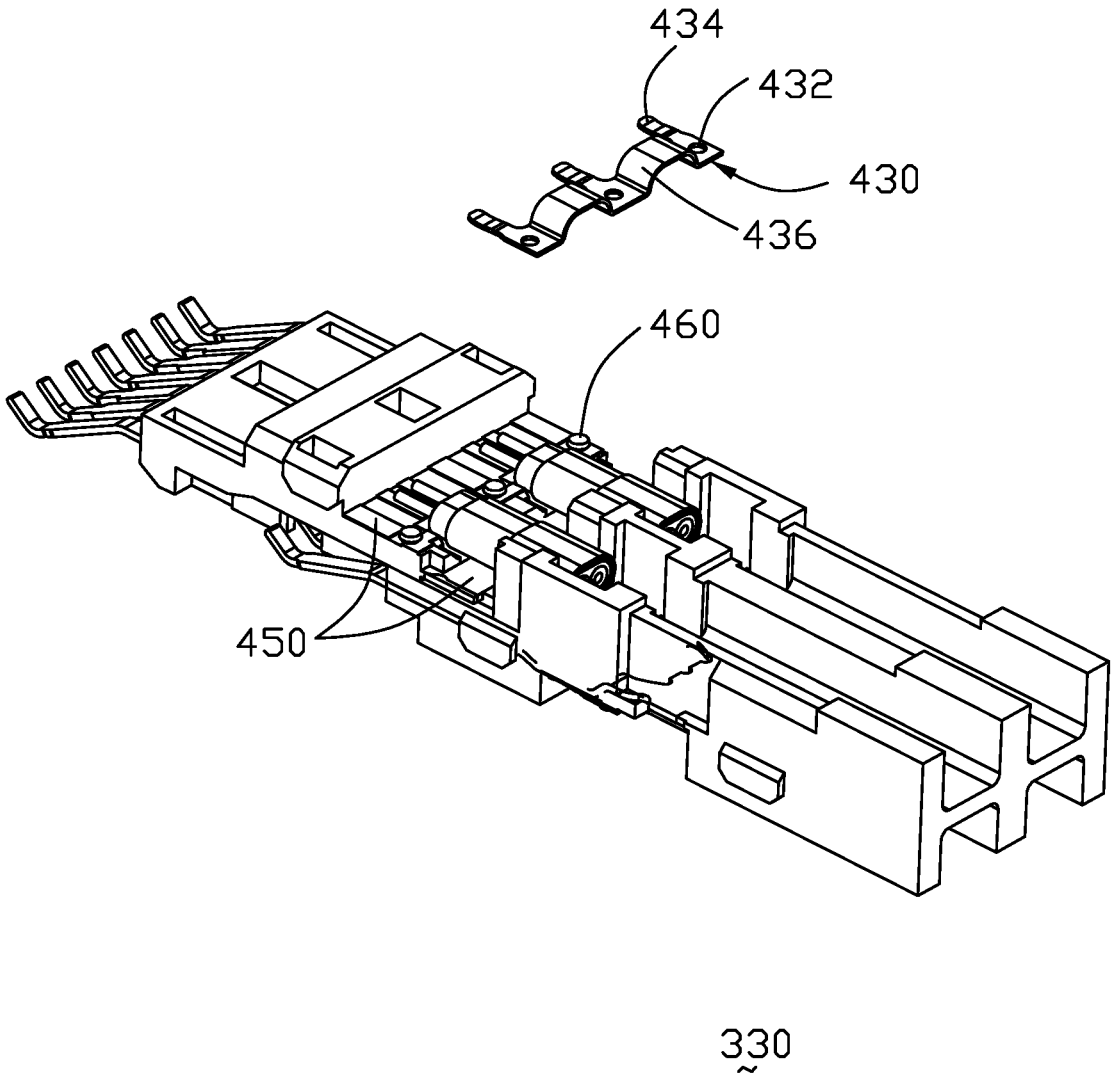
FIG. 25 is a further perspective view of the upper unit of the high speed contact module of the electrical connector assembly of FIG. 24.
Figure 26:
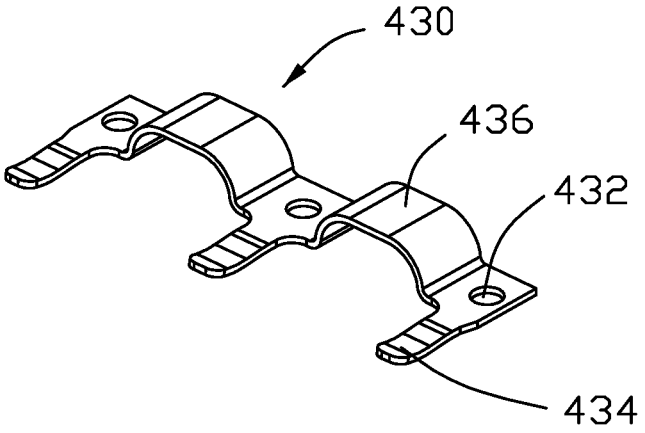
FIG. 26 is a perspective view of the grounding bar of the high speed contact module of the electrical connector assembly of FIG. 24.
Figure 27:
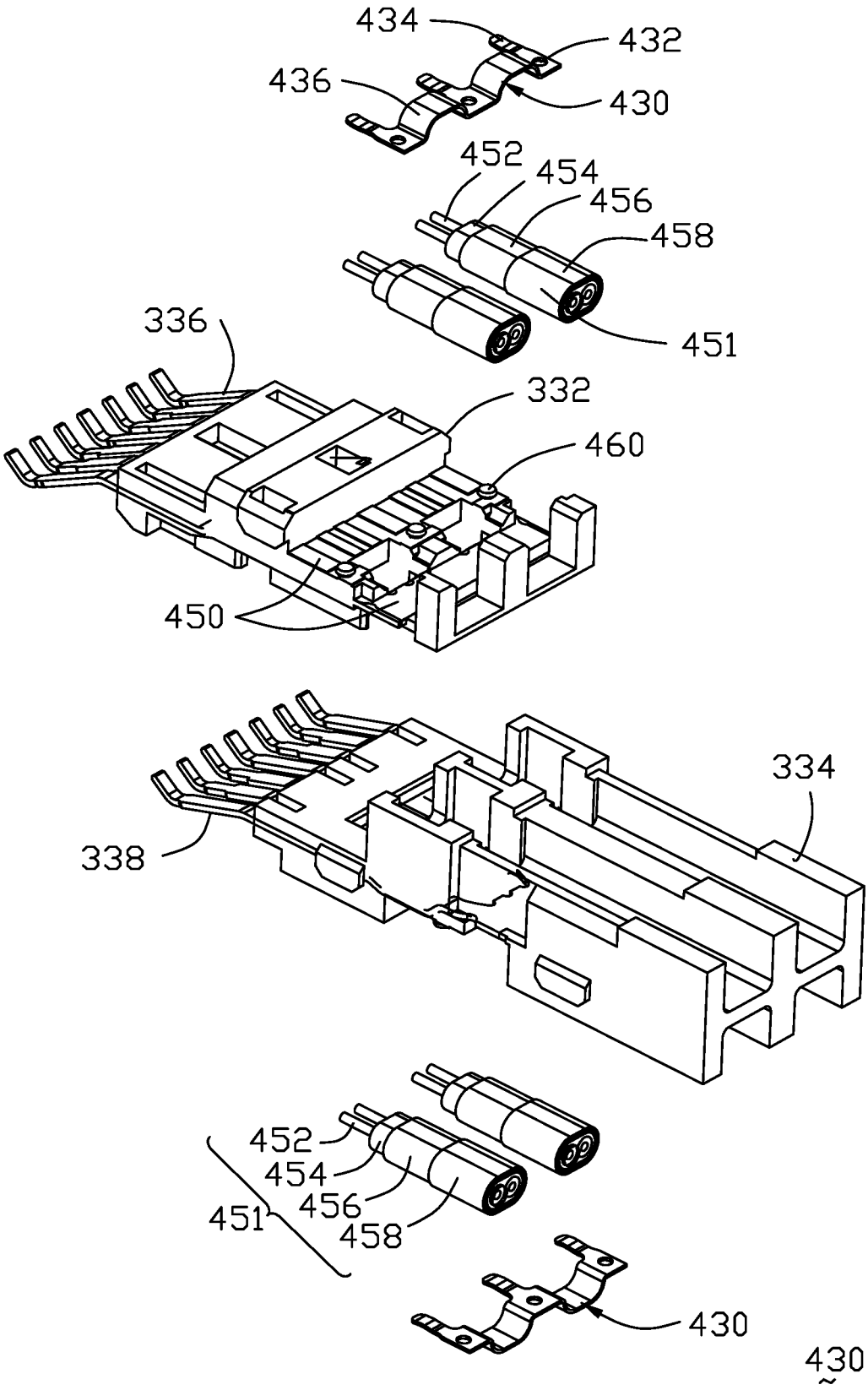
FIG. 27 is an exploded perspective view of the upper unit of the high speed contact module of the electrical connector assembly of FIG. 24.
Figure 28:
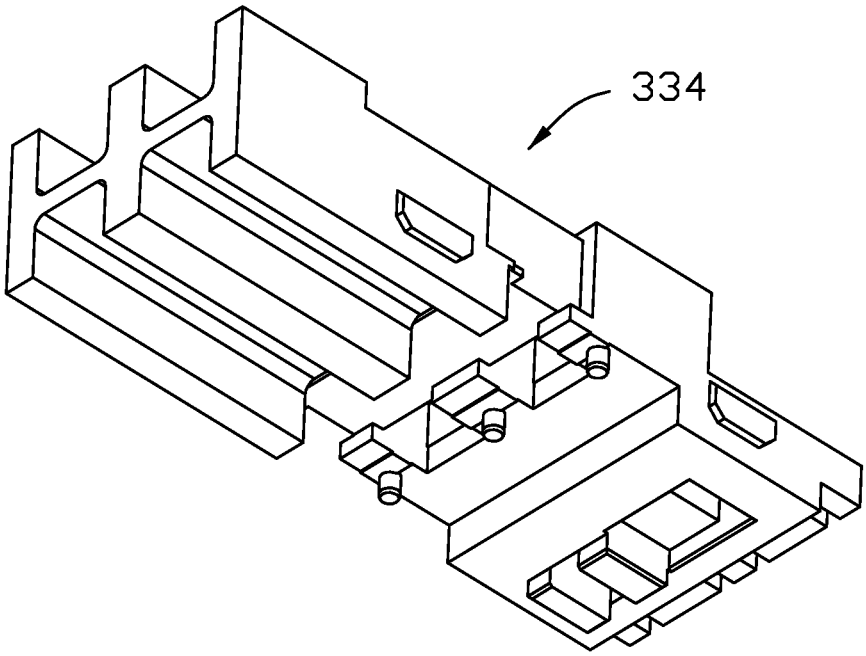
FIG. 28 is a perspective view of the rear subunit of the upper unit of the high speed contact module of the electrical connector assembly of FIG. 27.
Figure 29:
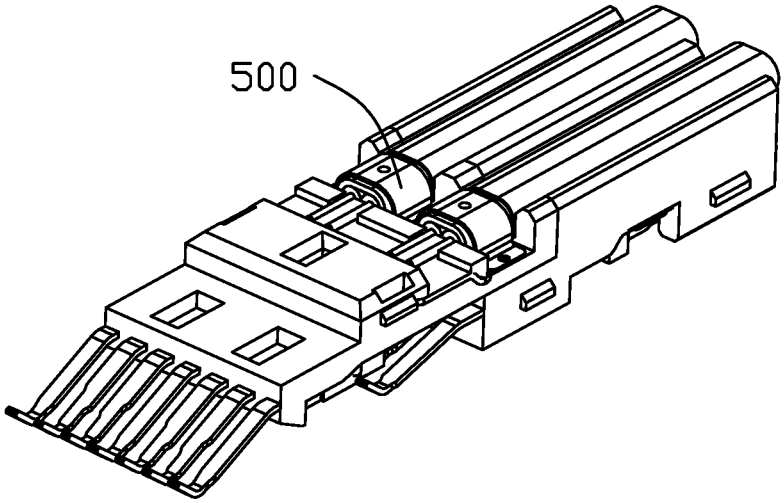
FIG. 29 is a perspective view of the upper unit of the high speed contact module of the electrical connector assembly according to a third embodiment of the invention.
Figure 30:
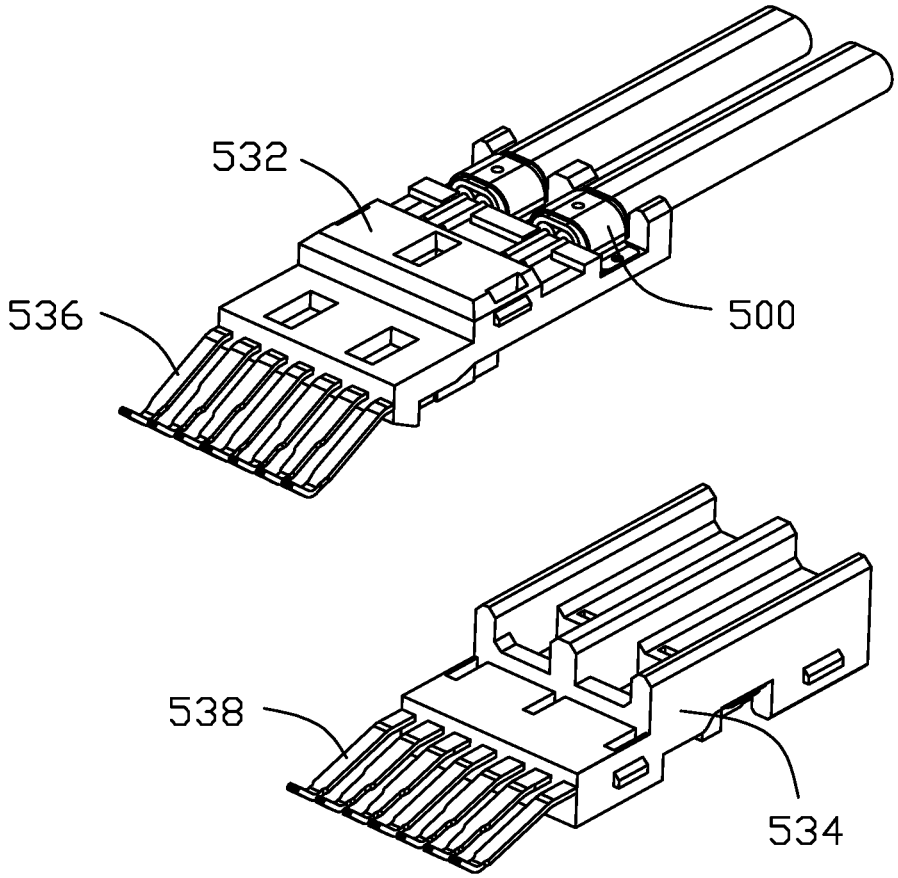
FIG. 30 is an exploded perspective view of the upper unit of the high speed contact module of the electrical connector assembly of FIG. 29.
Figure 31:
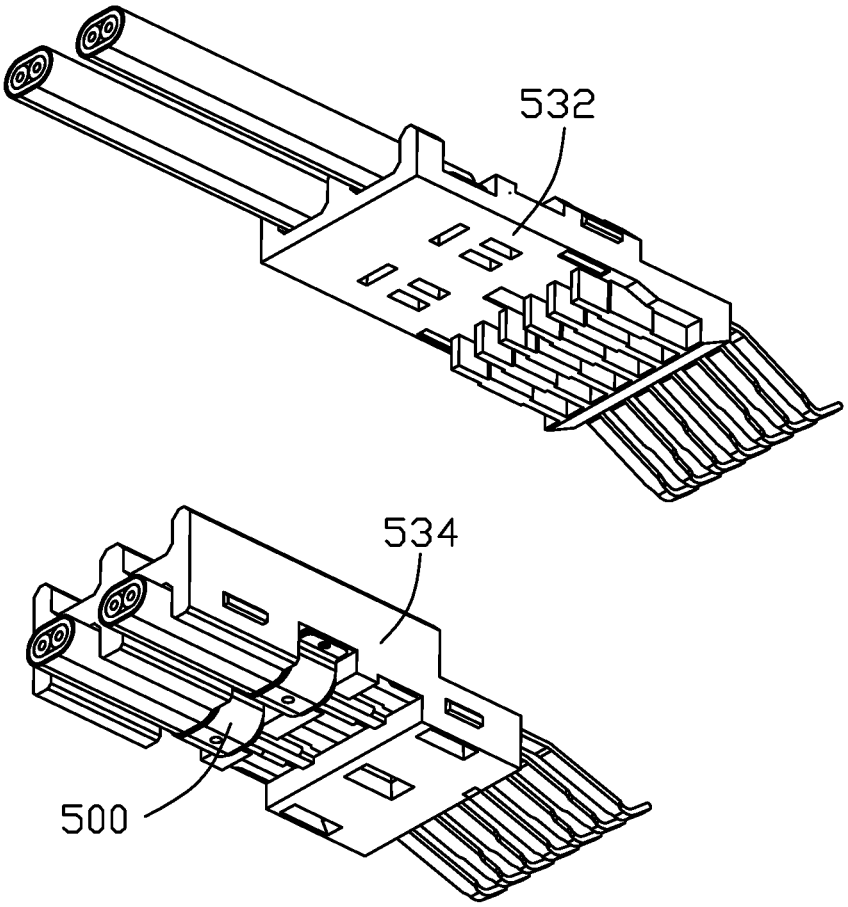
FIG. 31 is another exploded perspective view of the upper unit of the high speed contact module of the electrical connector assembly of FIG. 30
Figure 32:
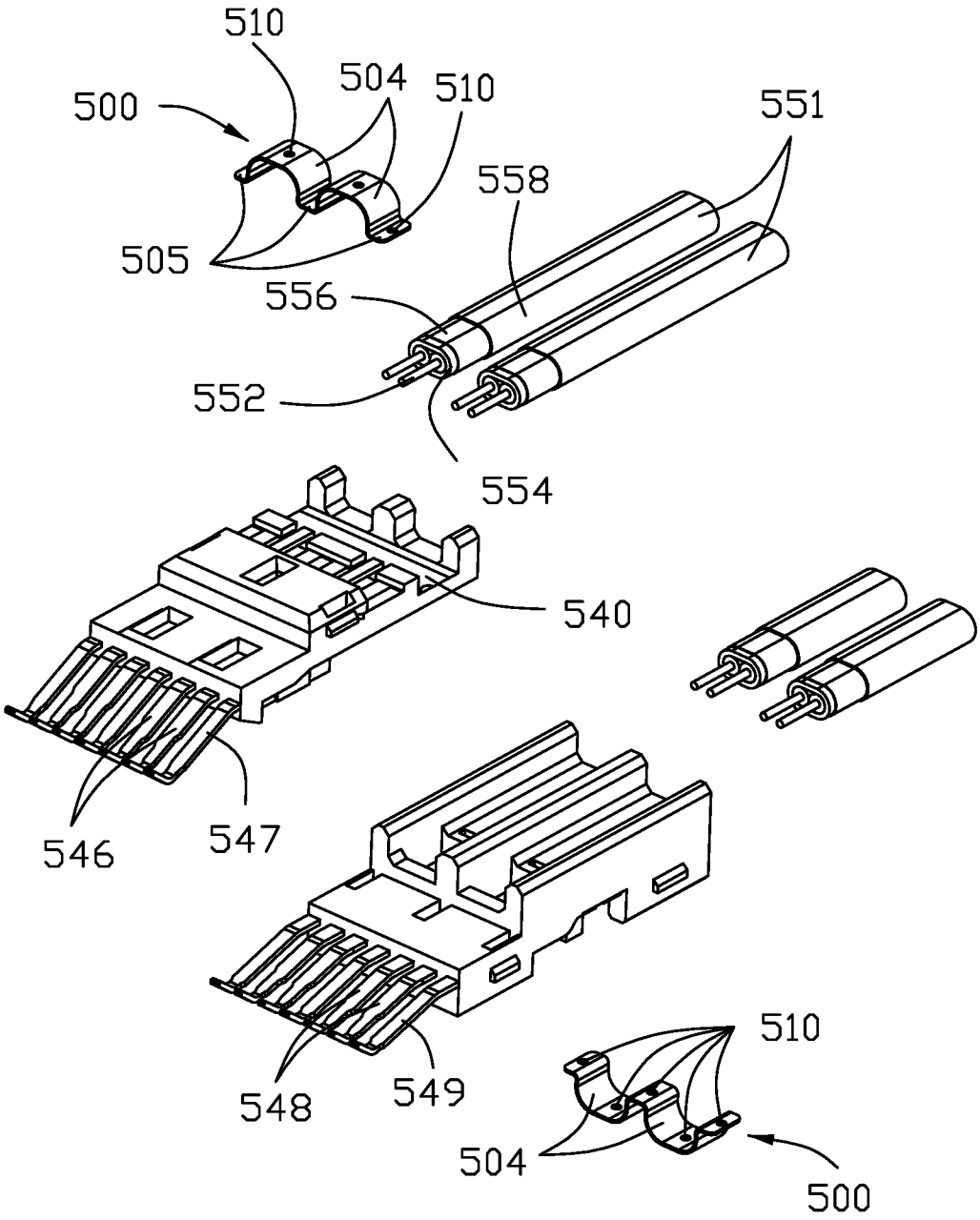
FIG. 32 is a further exploded perspective view of the upper unit of the high speed contact module of the electrical connector assembly of FIG. 30.
Figure 33:
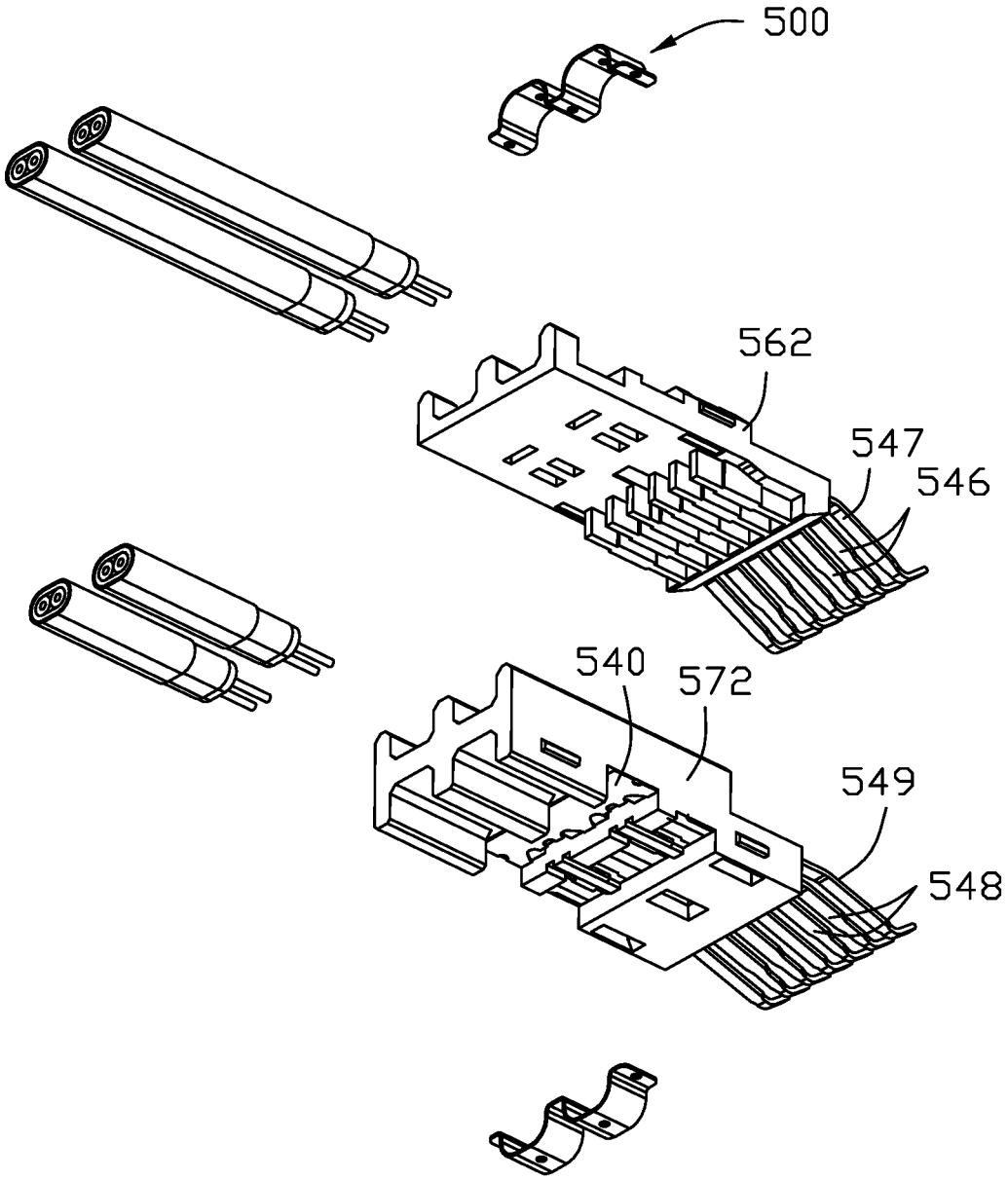
FIG. 33 is another exploded perspective view of the upper unit of the high speed contact module of the electrical connector assembly of FIG. 32
Figure 34:
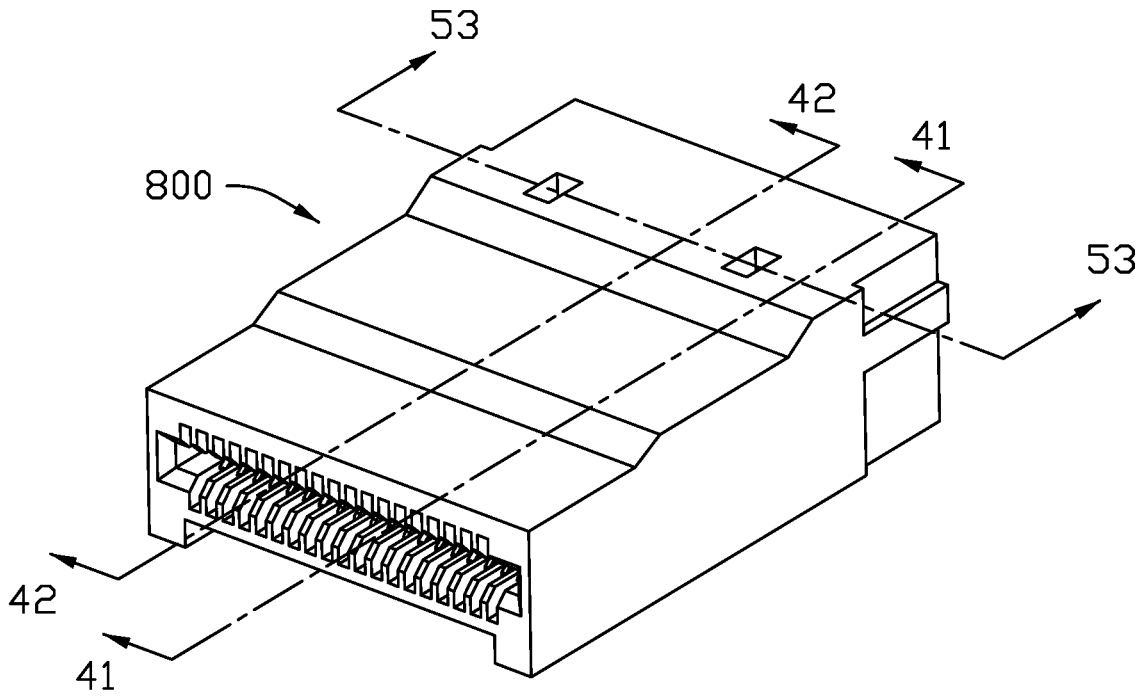
FIG. 34 is a perspective view of the electrical connector assembly according to a fourth embodiment of the present invention.
Figure 35:
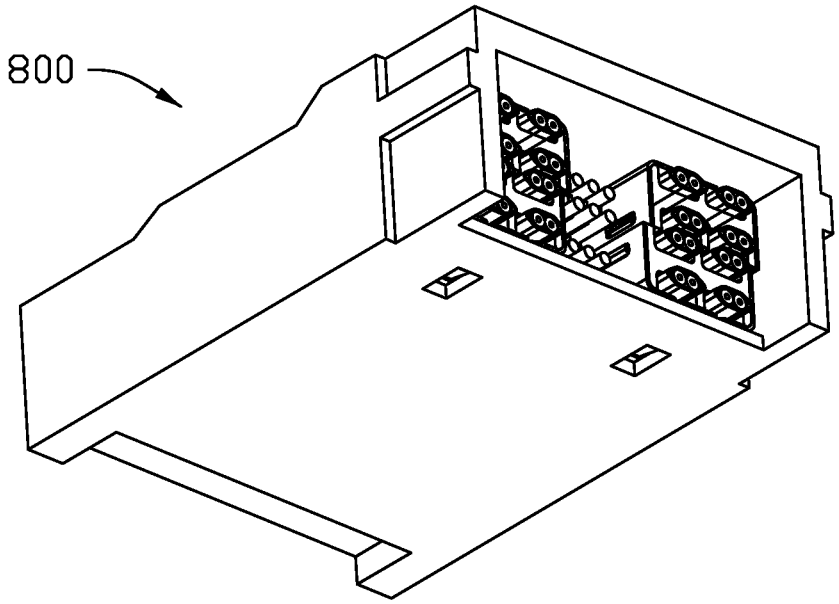
FIG. 35 is another perspective view of the electrical connector assembly of FIG. 34.
Figure 36:
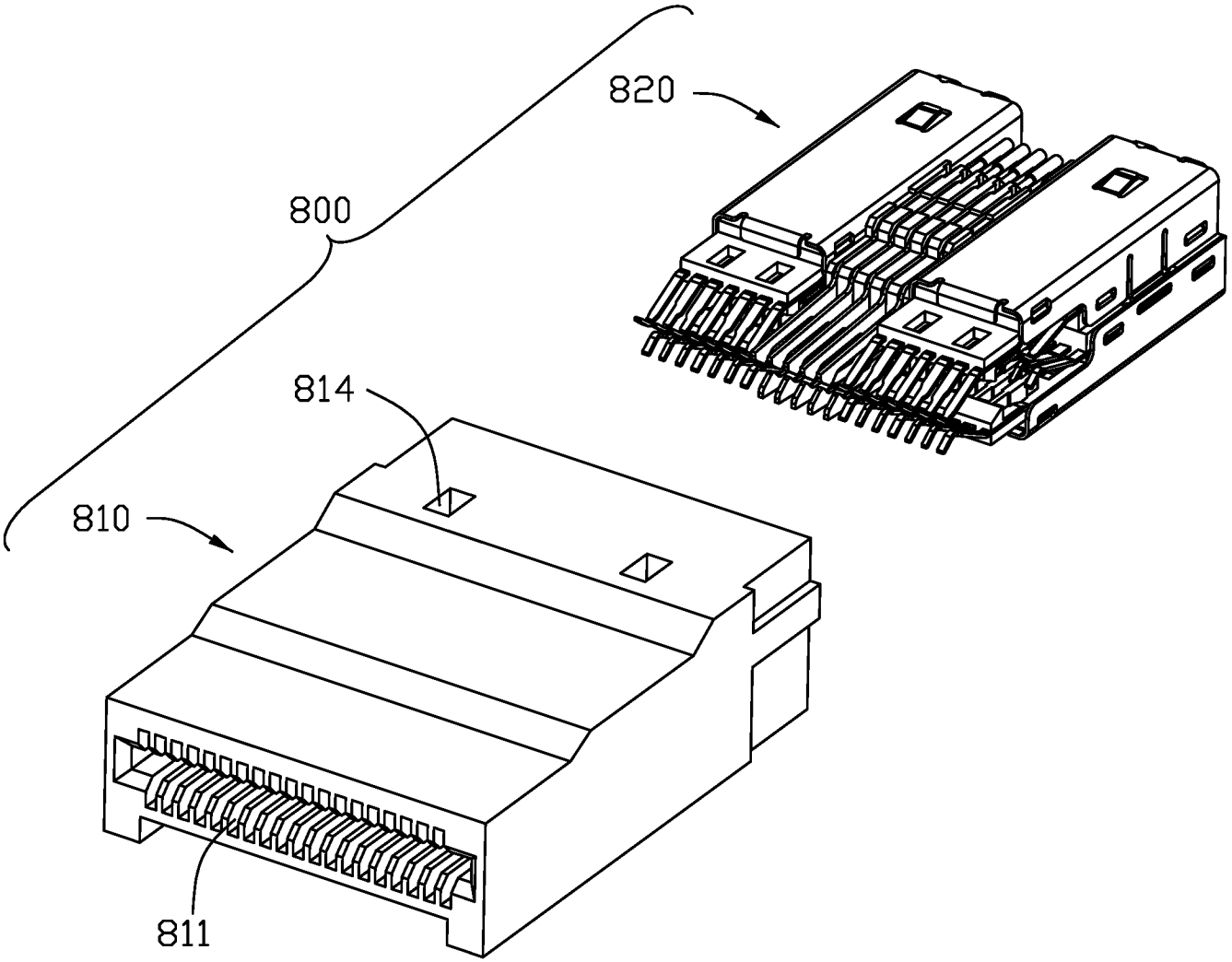
FIG. 36 is an exploded perspective view of the electrical connector assembly of FIG. 34.
Figure 37:
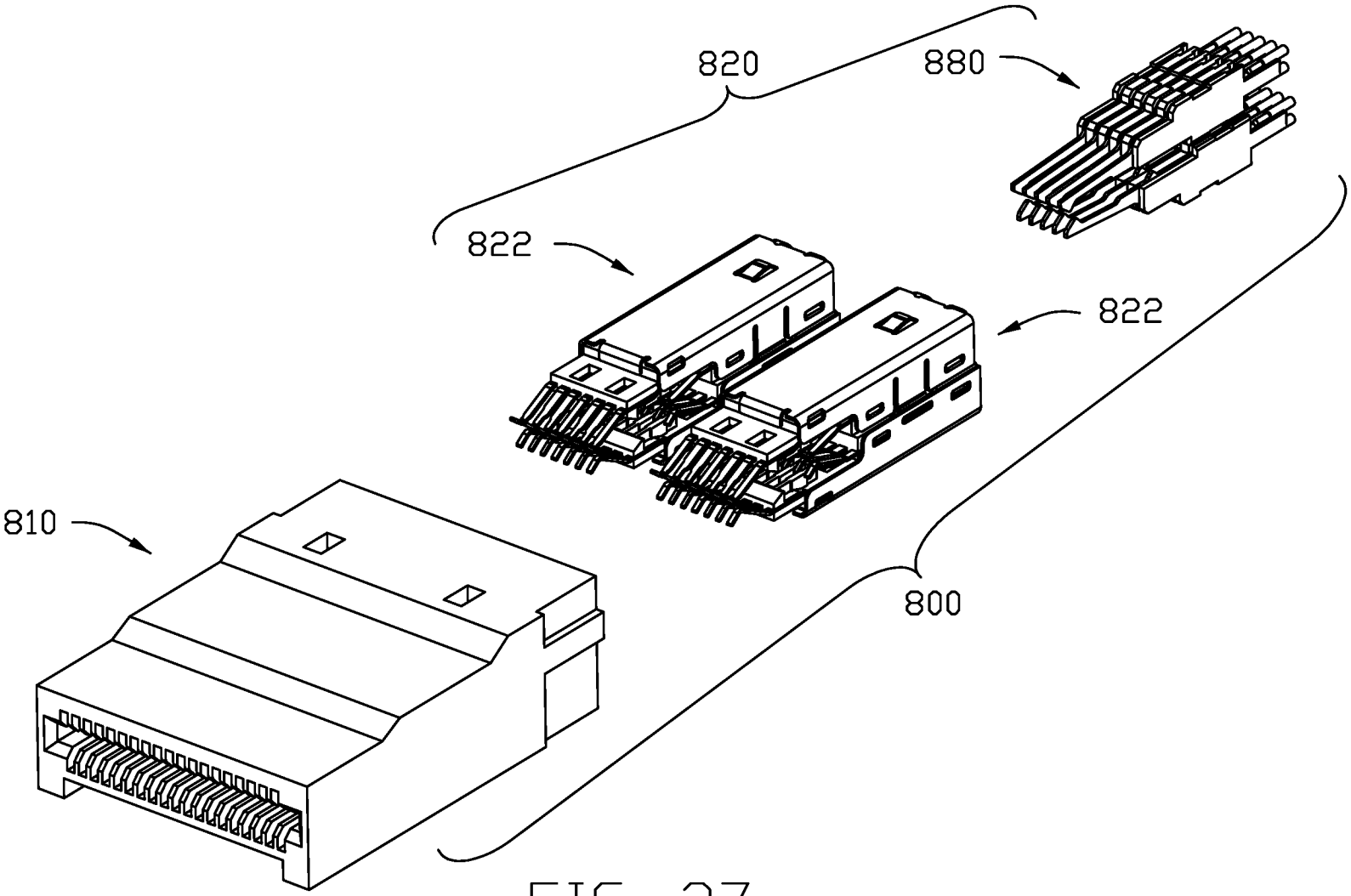
FIG. 37 is another exploded perspective view of the electrical connector assembly of FIG. 34.
Figure 38:
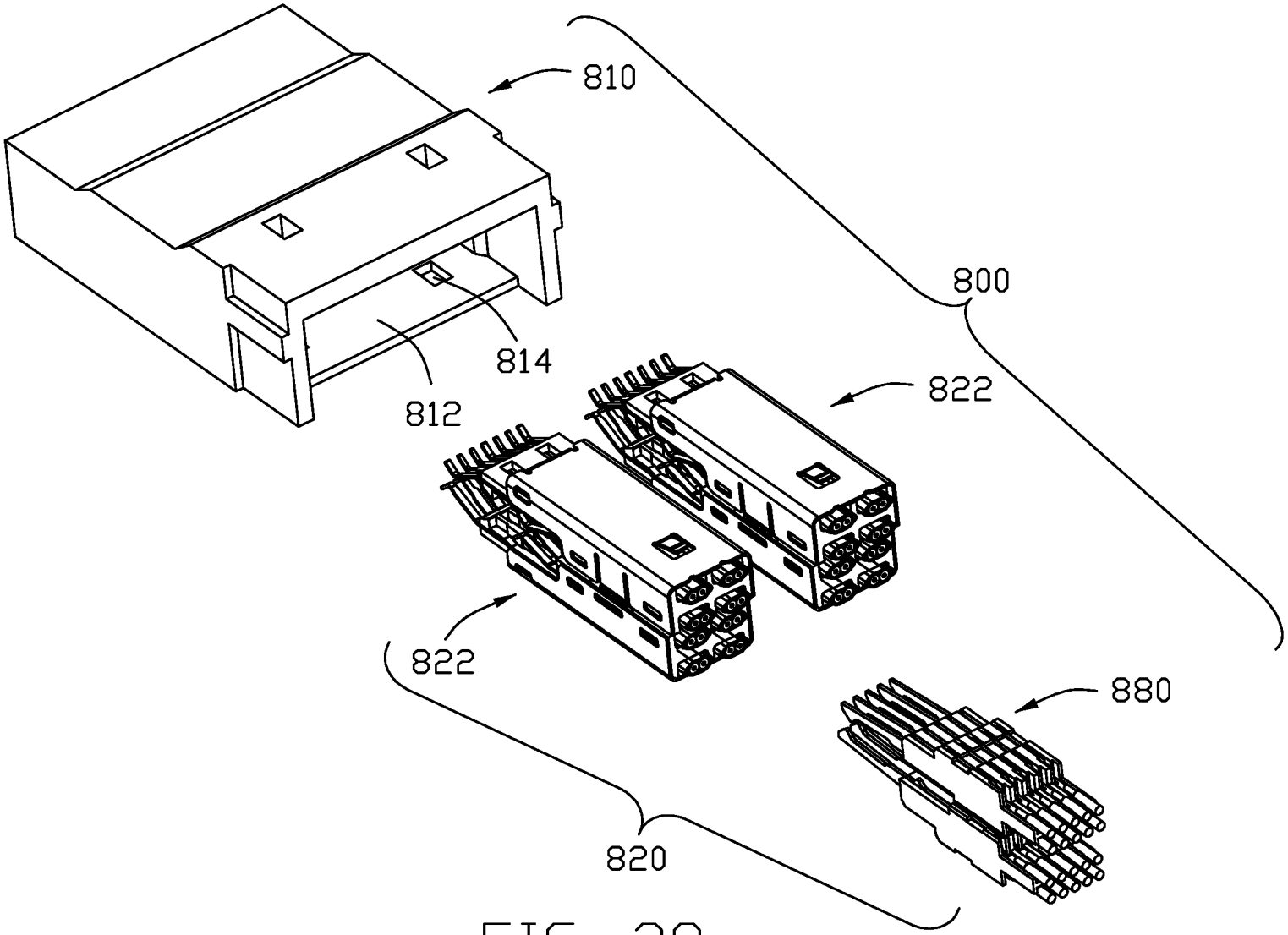
FIG. 38 is another perspective view of the electrical connector assembly of FIG. 37.
Figure 39:
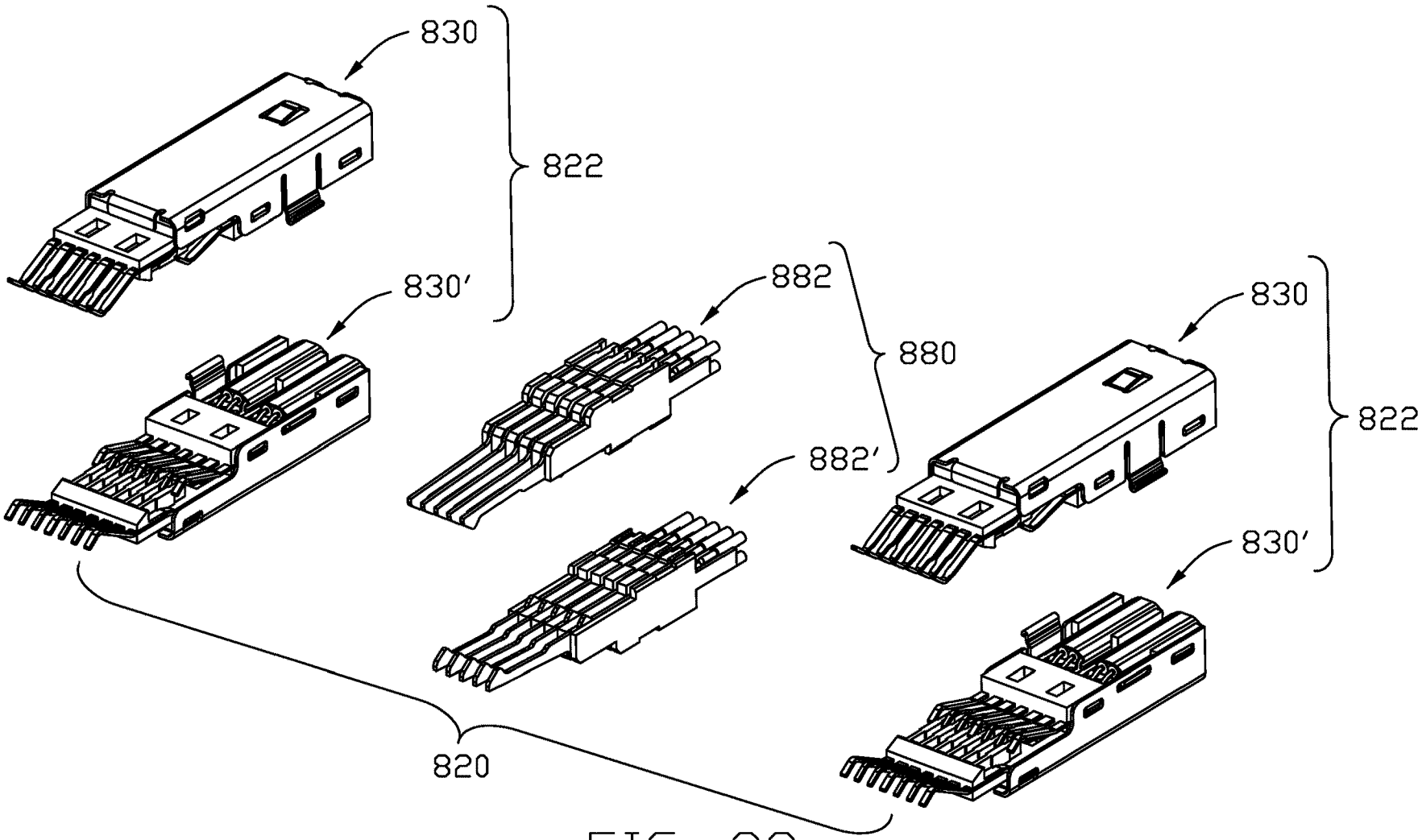
FIG. 39 is an exploded perspective view of the contact module assembly of the electrical connector assembly of FIG. 36.
Figure 40:
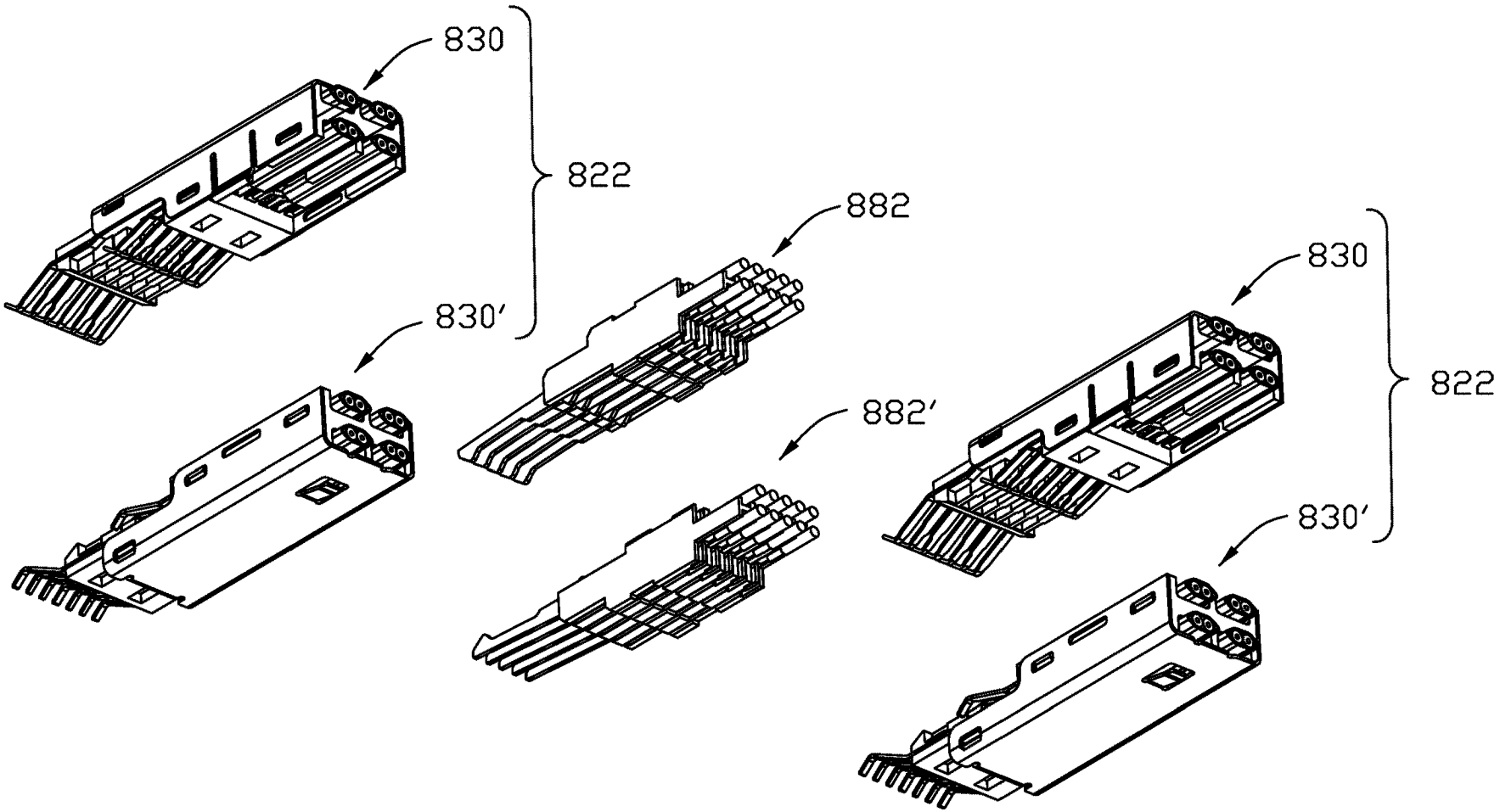
FIG. 40 is another exploded perspective view of the contact module assembly of the electrical connector assembly of FIG. 39.
Figure 41:
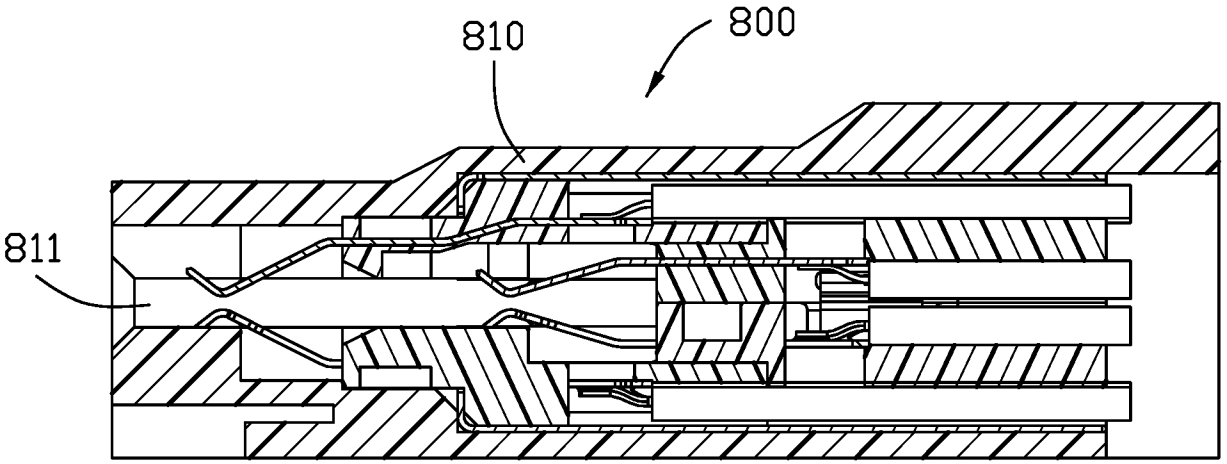
FIG. 41 is a cross-sectional view along line 41-41 of the electrical connector assembly of FIG. 34.
Figure 42:
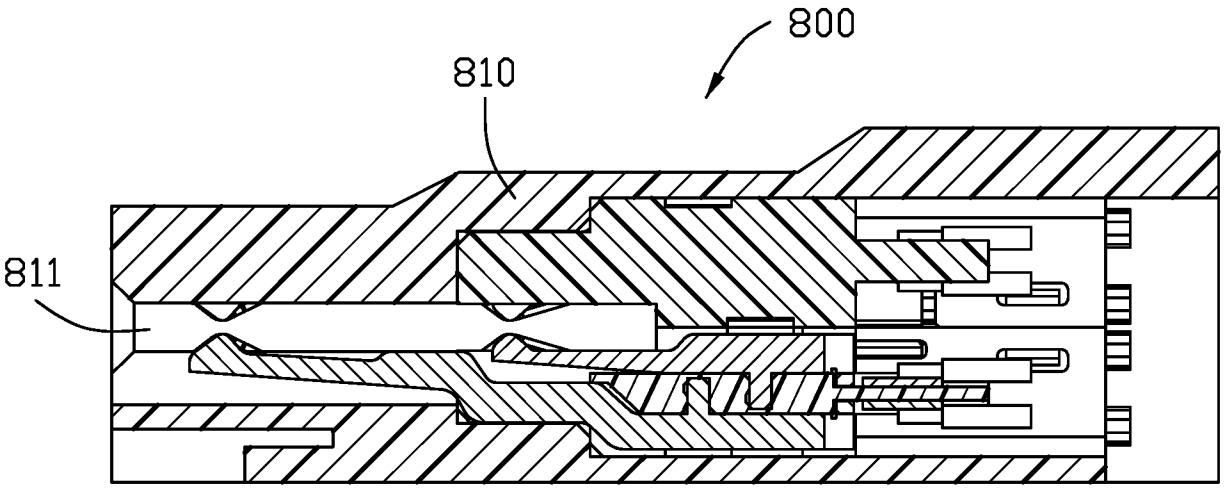
FIG. 42 is another cross-sectional view along line 42-42 of the electrical connector assembly of FIG. 41.
Figure 43:
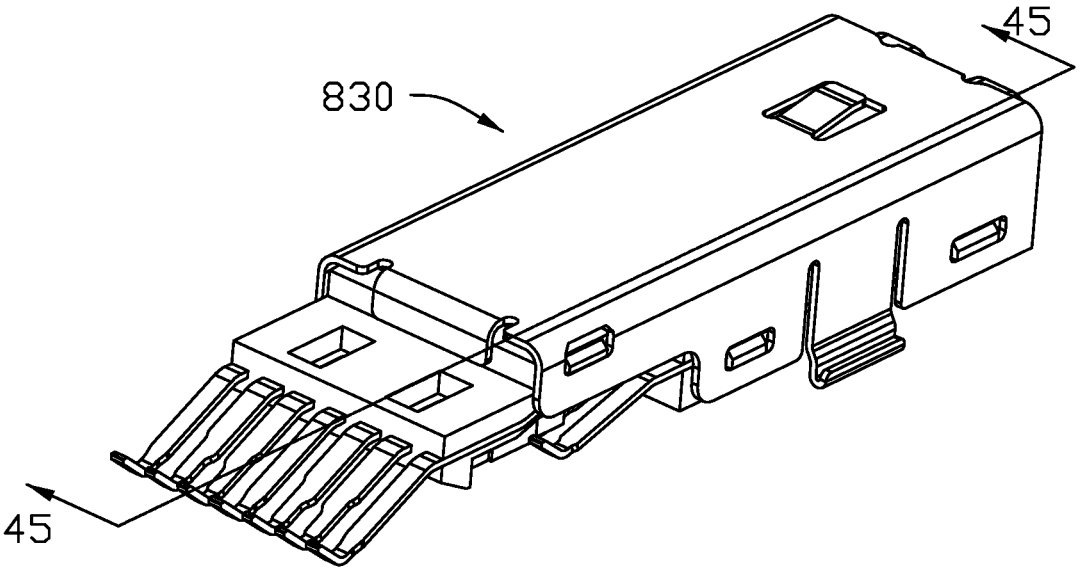
FIG. 43 is a perspective view of the upper unit of the high speed contact module of the electrical connector assembly of FIG. 39.
Figure 44:
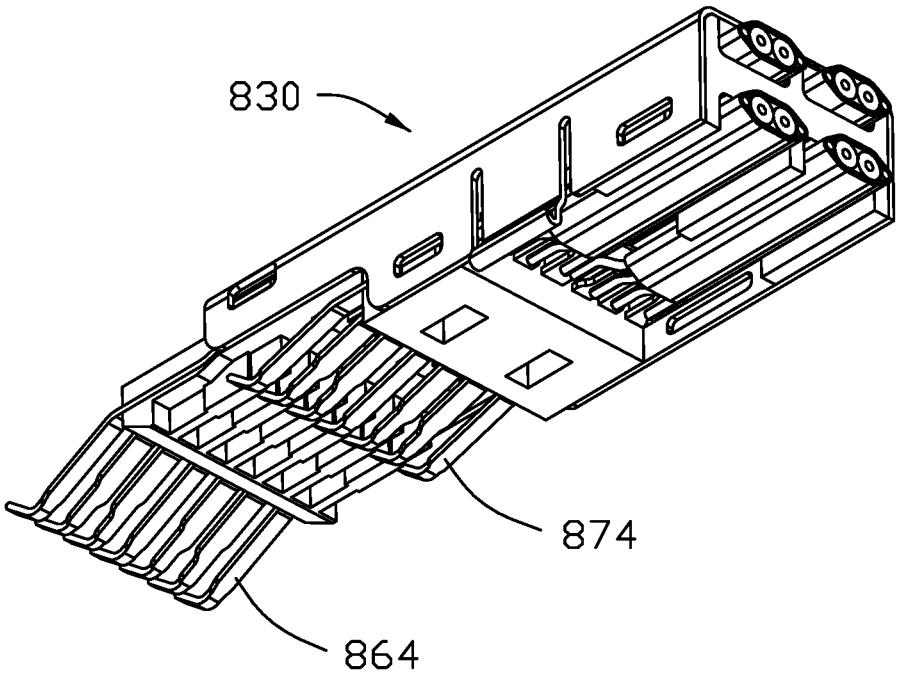
FIG. 44 is another perspective view of the upper unit of the high speed contact module of the electrical connector assembly of FIG. 43.
Figure 45:
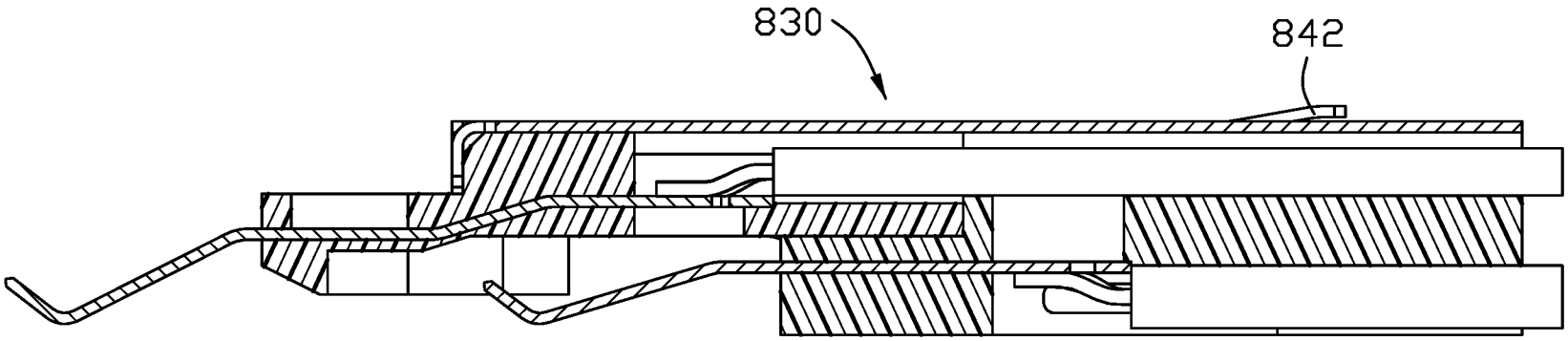
FIG. 45 is a cross-sectional view along line 45-45 of the electrical connector assembly of FIG. 43.
Figure 46:
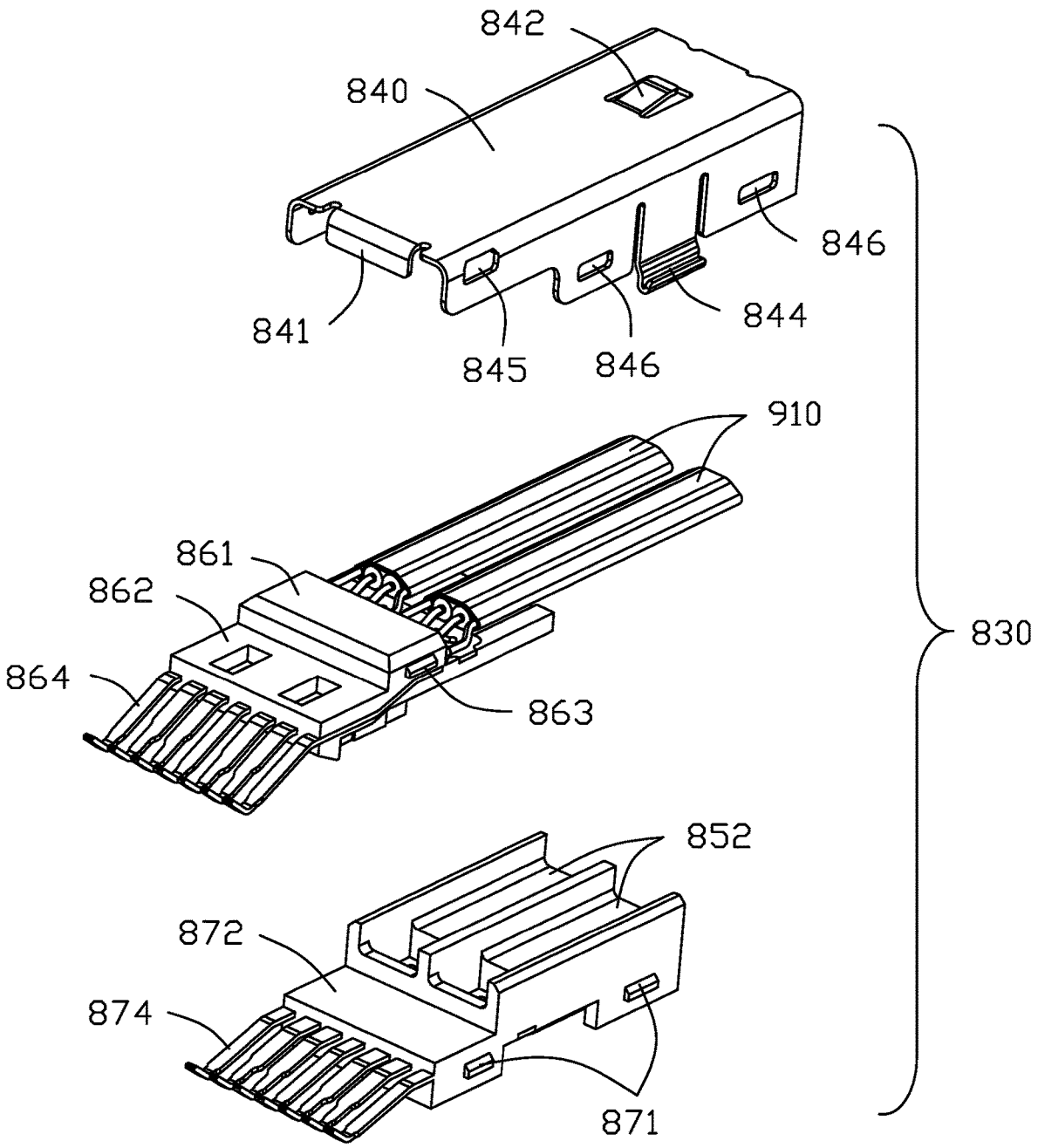
FIG. 46 is an explode perspective view of the upper unit of the high speed contact module of the electrical connector assembly of FIG. 43.
Figure 47:
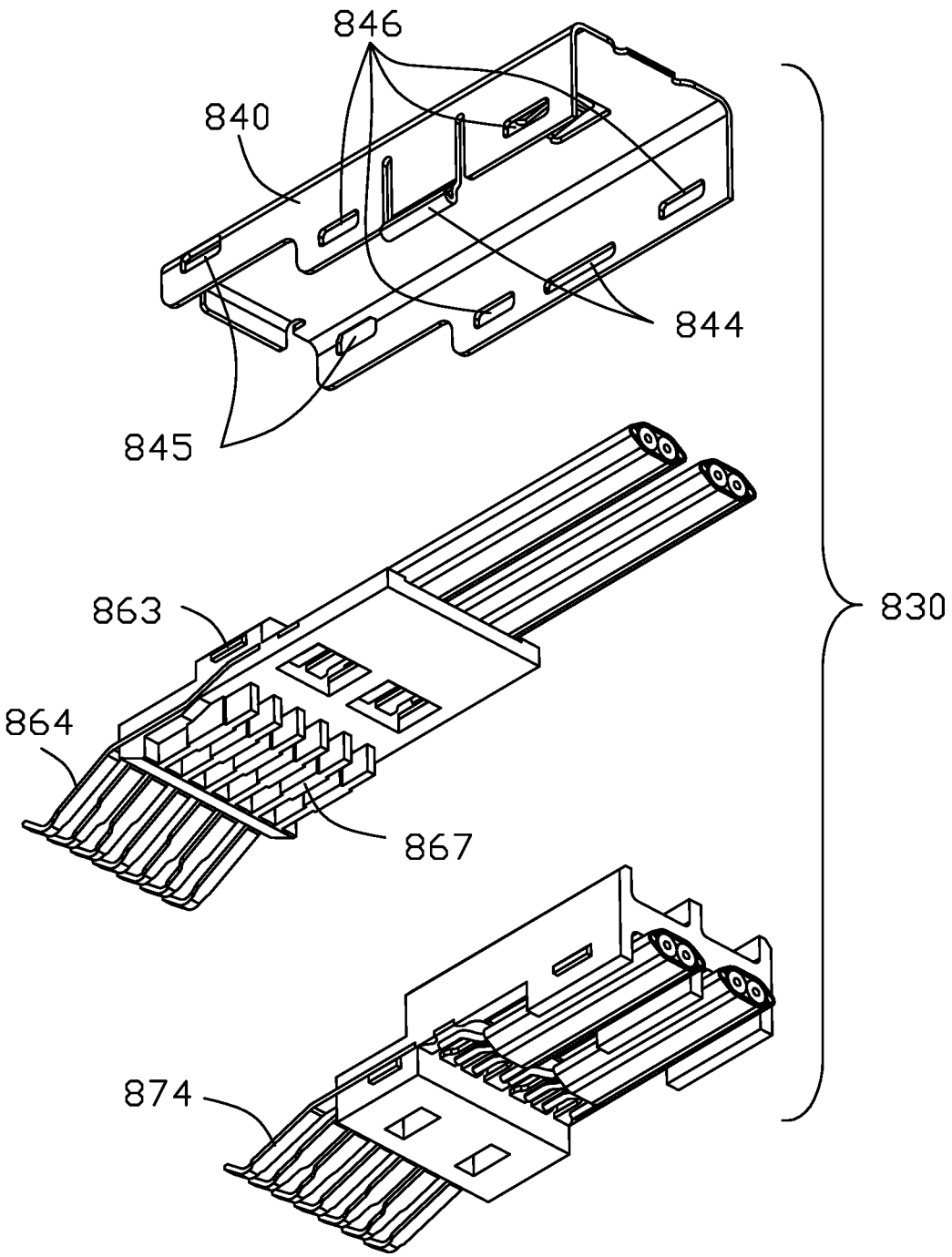
FIG. 47 is another exploded perspective view of the upper unit of the high speed contact module of the electrical connector assembly of FIG. 46.
Figure 48:
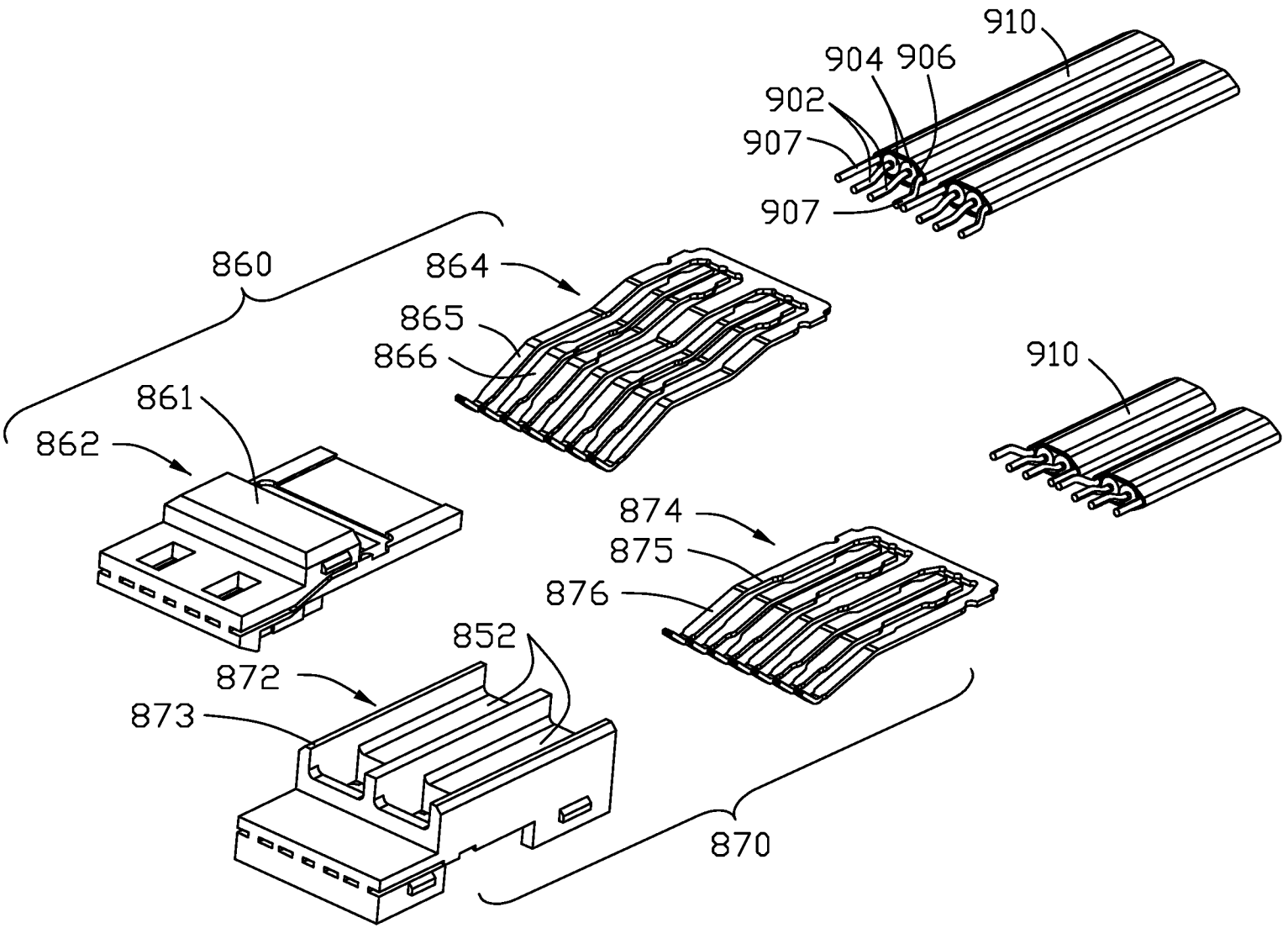
FIG. 48 is a further exploded perspective view of the upper unit of the high speed contact module of the electrical connector assembly.
Figure 49:
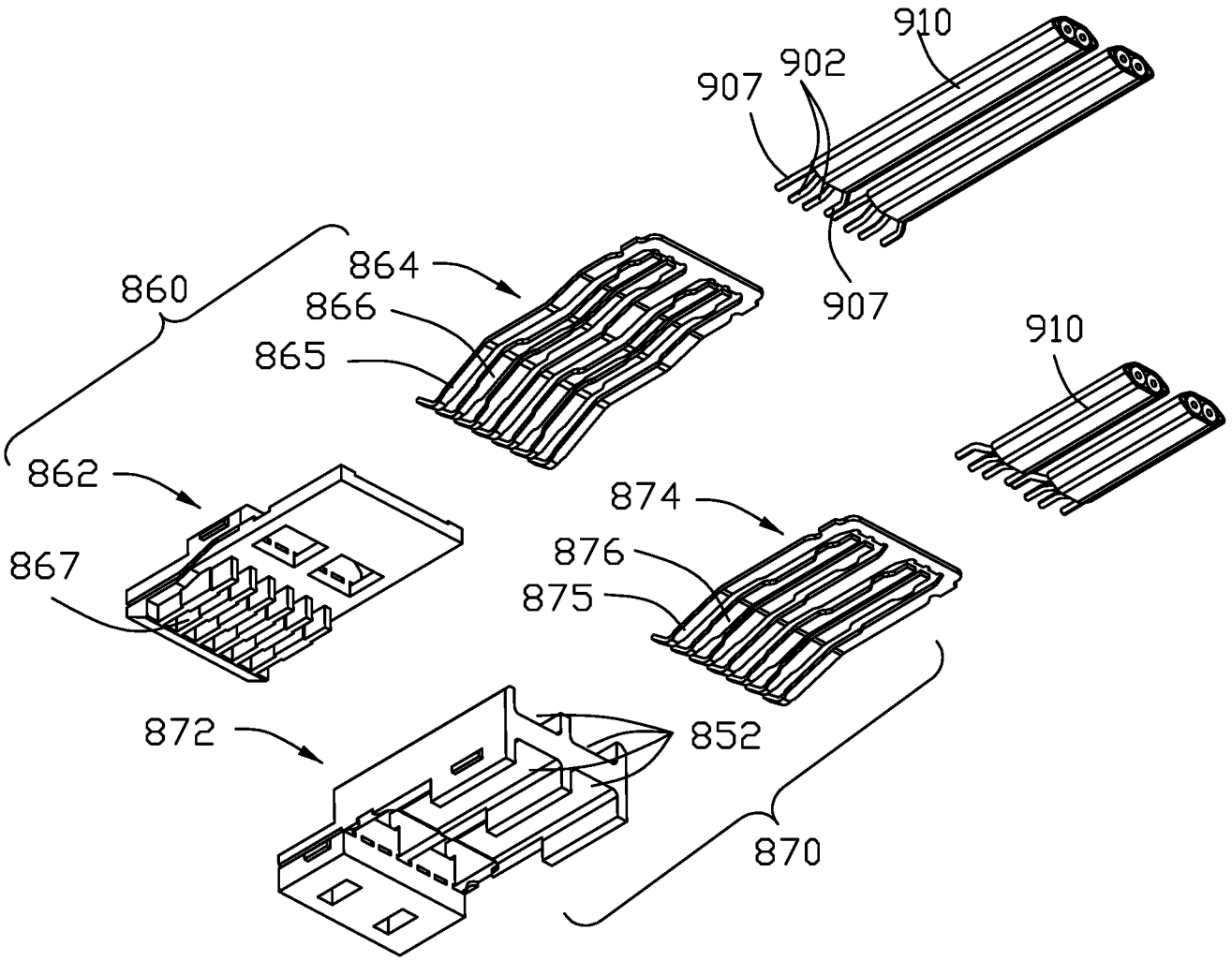
FIG. 49 is another perspective view of the upper unit of the high speed contact module of the electrical connector assembly of FIG. 48.
Figure 50:
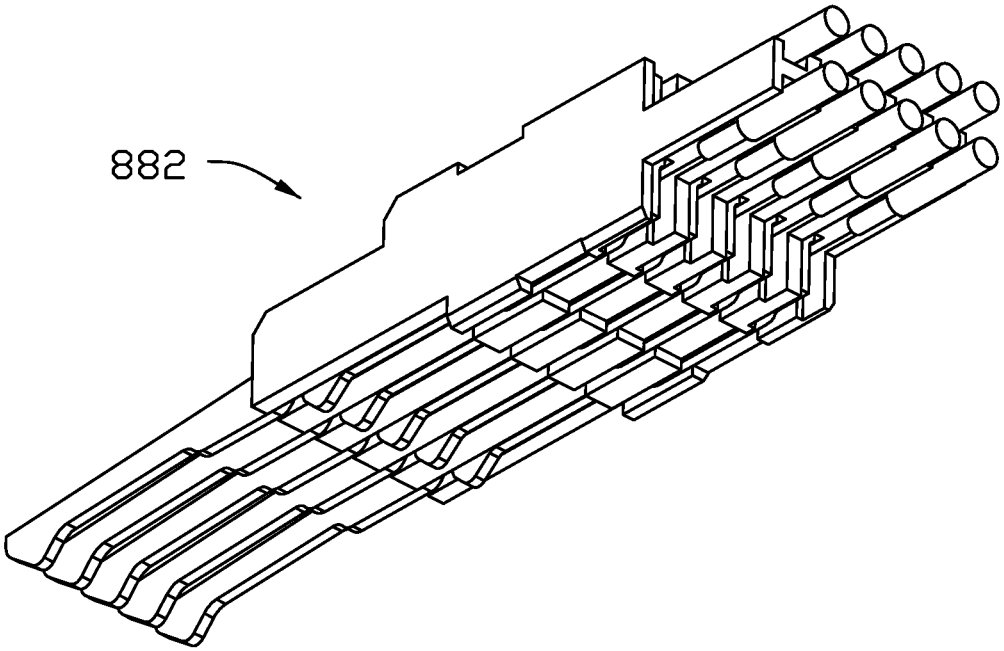
FIG. 50 is a perspective view of the sideband contact module of the contact module assembly of the electrical connector assembly of FIG. 39.
Figure 51:
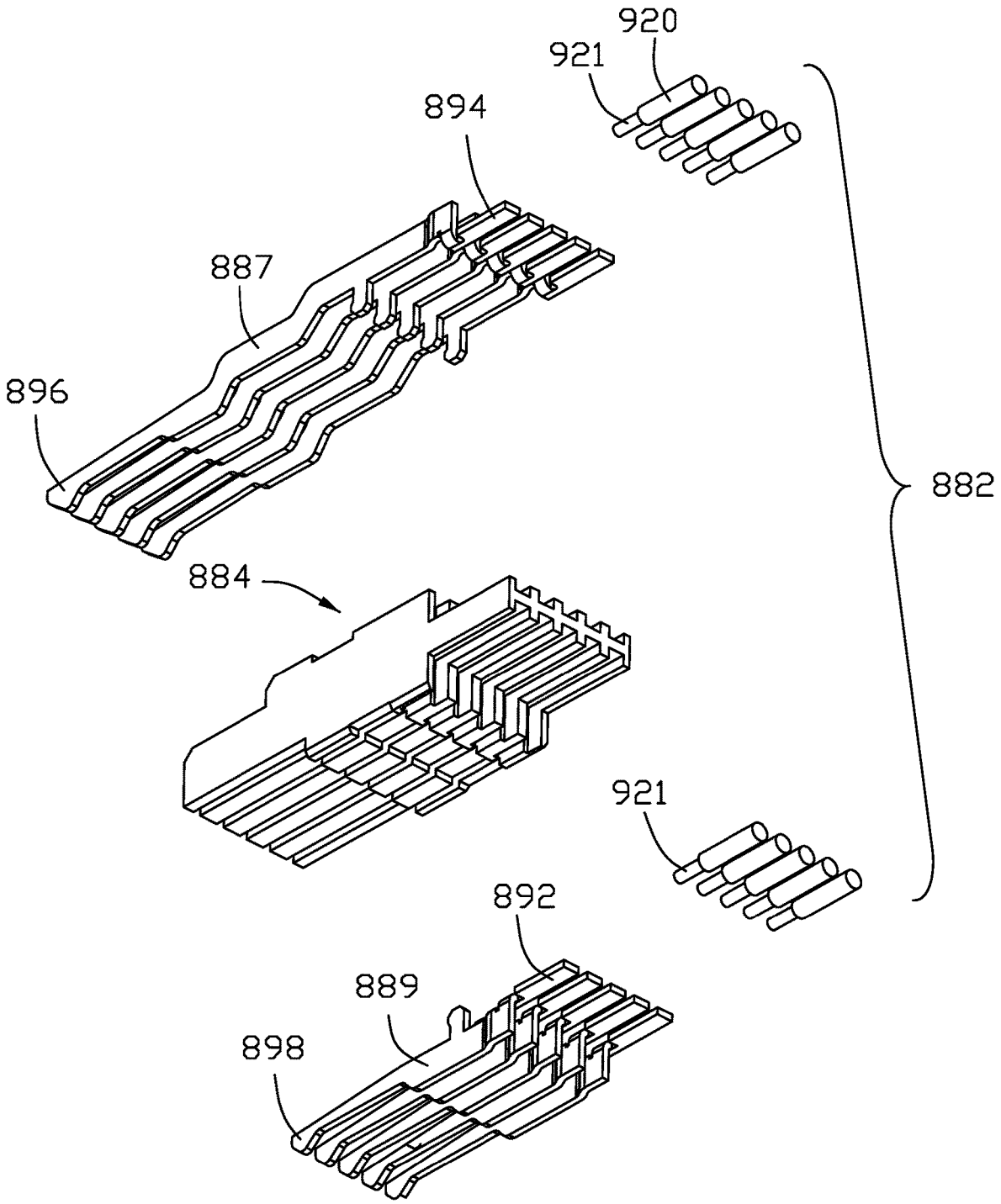
FIG. 51 is an exploded perspective view of the sideband contact module of the contact module assembly of the electrical connector assembly of FIG. 50.
Figure 52:
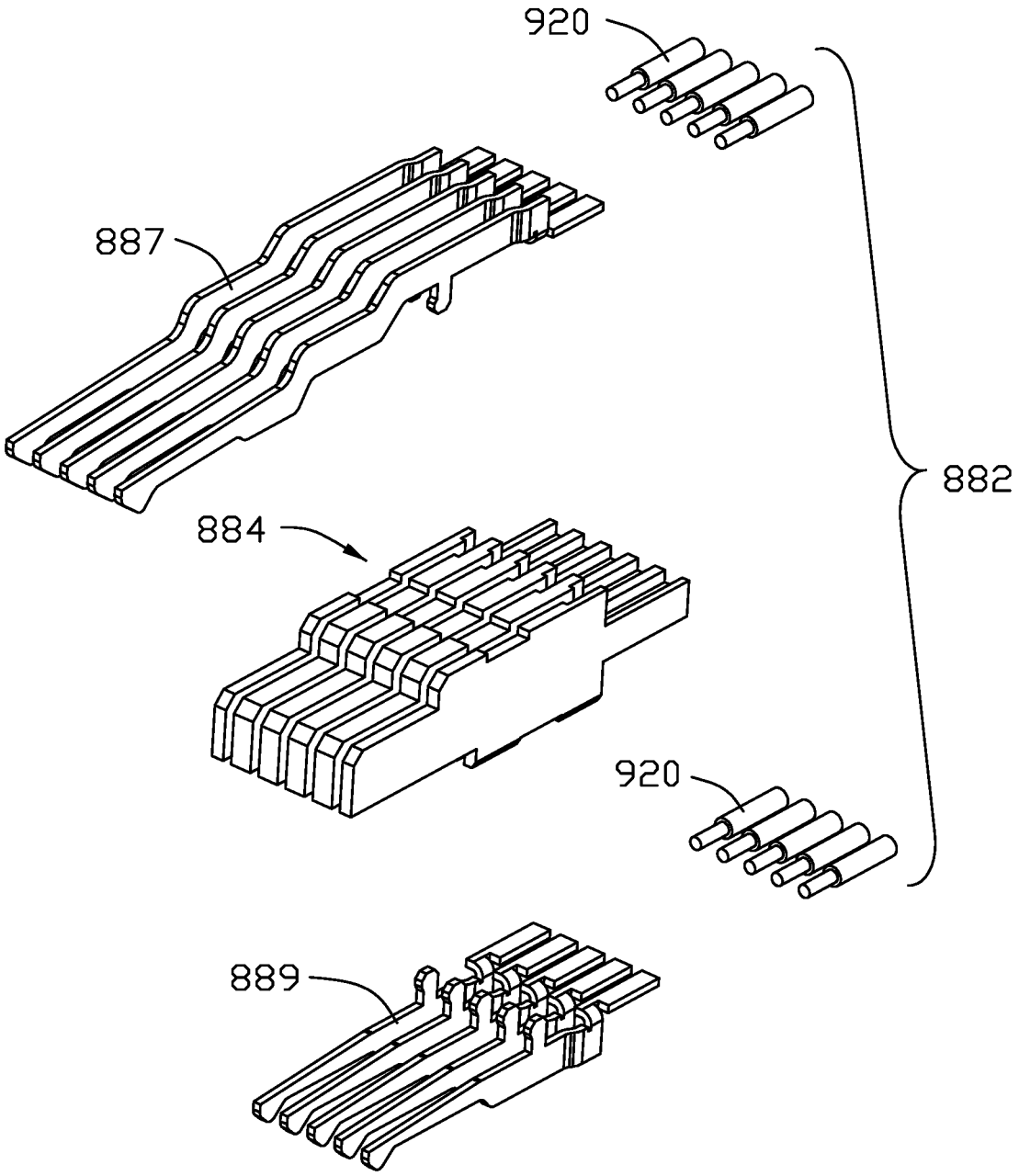
FIG. 52 is another perspective view of the sideband contact module of the contact module assembly of the electrical connector assembly of FIG. 51.
Figure 53:
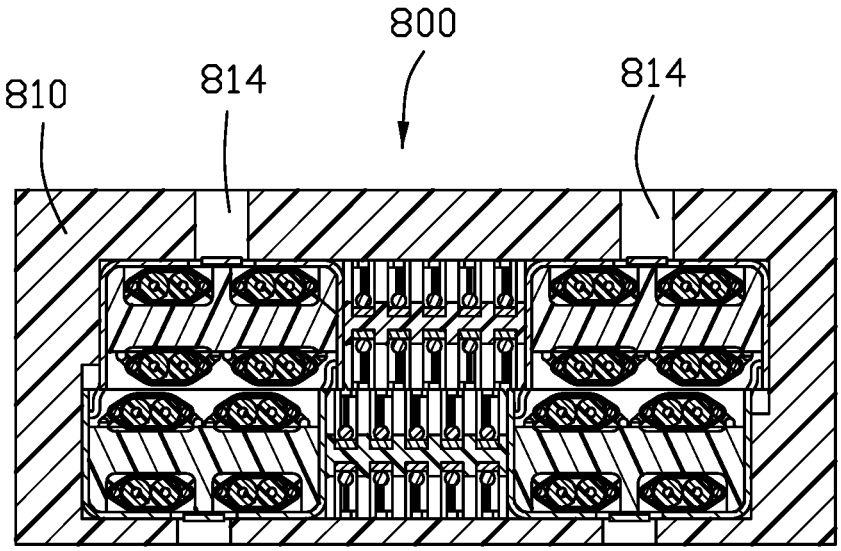
FIG. 53 is a rear view along line 53-53 of the electrical connector assembly of FIG. 34.
Figure 54:
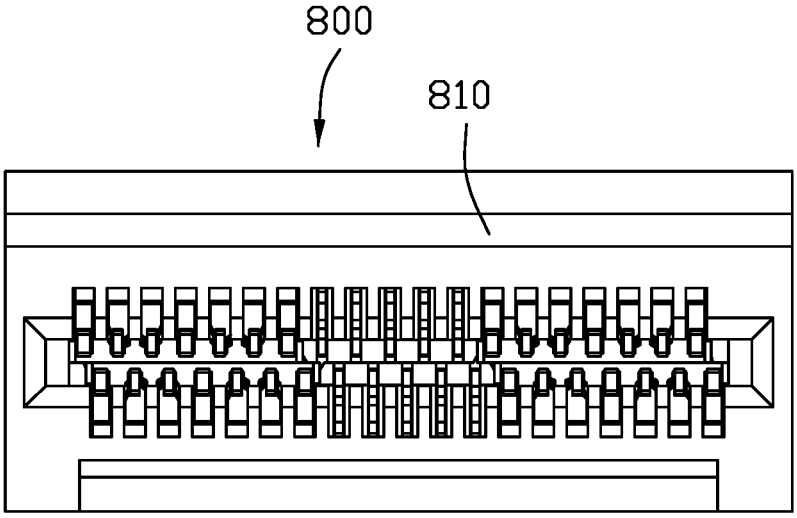
FIG. 54 is a front view of the electrical connector assembly of FIG. 34.
Figure 55:
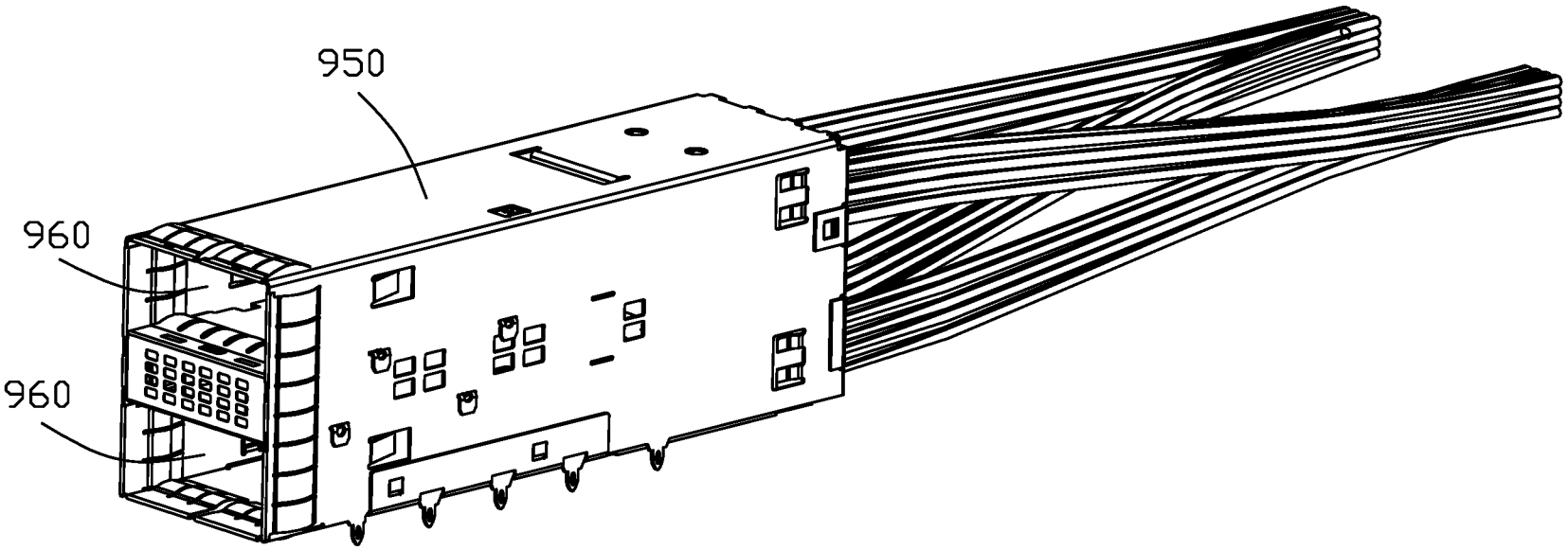
FIG. 55 is a perspective view of the electrical connector assembly of FIG. 1 or FIG. 34 including a cage.
Figure 56:
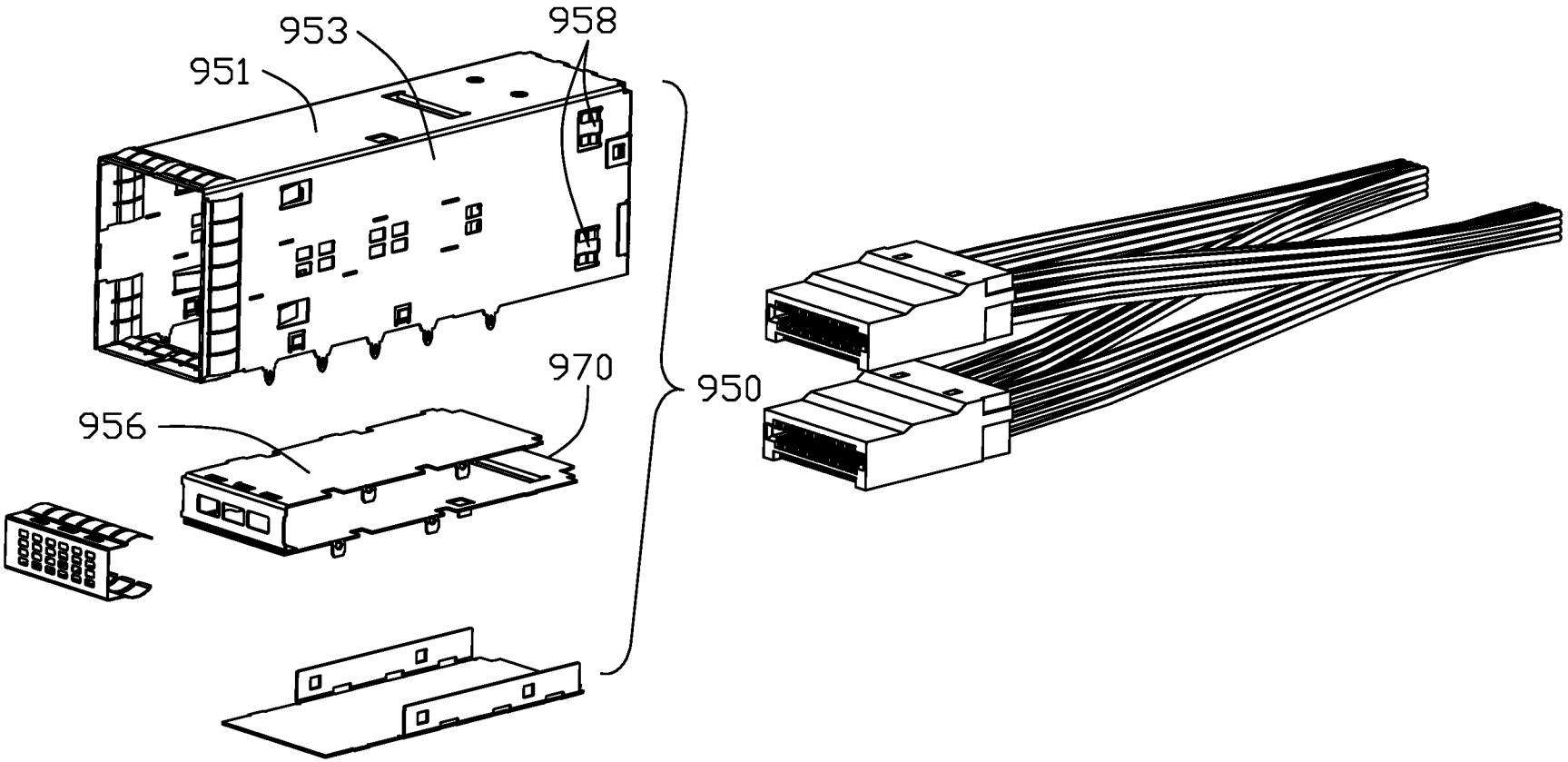
FIG. 56 is an exploded perspective view of the electrical connector assembly of 55.
Figure 57:
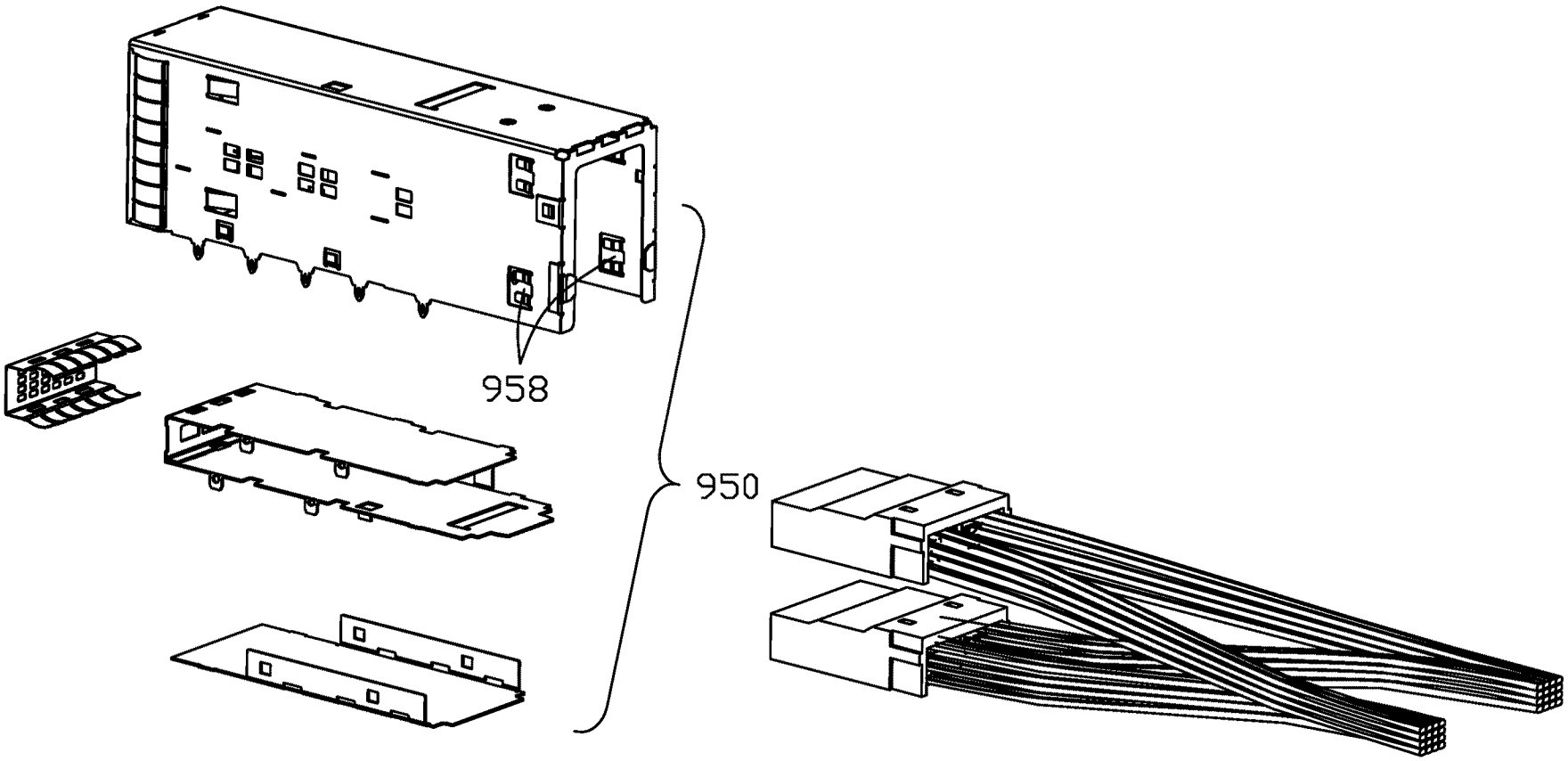
FIG. 57 is another perspective view of the electrical connector assembly of FIG. 56.

Notably, via cooperation of the openings 148, 149 in the shell 140 and the protrusions 161, 163 of the insulator 162, and the protrusions 173 and 179 on the insulator 172, the shell 140 and the insulators 162, 172 are secured to each other in the front-to-back direction. The rea/inner insulator 172 further forms a plurality of side protrusions 171 to be received within the corresponding securing apertures 114, respectively, thus assuring securement between the shell 140 and the insulators 162, 172 in both the vertical direction and the front-to-back direction. As shown in FIG. 16, a plurality of protrusions 177 are formed in an underside of the insulator 172 to be received within a corresponding recess form in the lower unit 130', and a recess 178 is formed in the underside of the insulator 172 to receive the corresponding protrusions extending upwardly from the lower unit 130', thus assuring retention between the upper unit 130 and the lower unit 130' in the front-to-back direction and the transverse direction.

Notably, after assembled, the shell 140 is retained to the insulator 172 via engagement of the protrusions 171 within the corresponding securing apertures 146 with the insulator 162 is sandwiched between the shell 140 and the insulator 172 in the vertical direction. The shell 140 of the upper unit 130 further forms a pair of retention sections 144 to retain to the corresponding retention sections of the shell of the lower unit 130'. In the insulator 162, the three protrusions 163 form a pair of passages (not labeled) therebetween to allow extension of the corresponding cables 200. Similarly, the insulator 172 forms a pair of upper passages 152 in an upper side to receive the corresponding two cables 200 which are linked to the upper unit 160, and a pair of lower passages 152 to receive the two corresponding cables 200 which are linked to the lower unit 170. The shell 140 further includes a securing tang 142 which will be securely retained in the securing aperture 114 when the contact module assembly 120 is assembled into the housing 110.

The cable 200 includes a pair of inner conductors 202, a pair of inner insulative layer 204, a common metallic/shielding braiding layer 206 and a common outer insulative layer (jacket) sequentially arranged with one another. The inner conductor 202 is soldered upon the tail of the differential pair contact 166, the braiding layer 206 is mechanically and electrically connected to the transverse bar of the grounding contacts 165. A grounding bar 300 which is discrete from the grounding contacts 165, includes three holes 302 through which the deformable posts 169 extend for securing the grounding bar 300 on the insulator 162, and three beams 304 respectively contacting the corresponding grounding contacts 165, and two bulged sections 304 each of which may cover the whole exposed insulative layer 204 in the vertical direction for lowing the impedance, compared with the traditional design with the exposed insulative layer 204 while without the grounding bar covering such an exposed insulative layer 204. The grounding bar 300 may optionally further cover the upper part of a front edge region of the braiding layer 206, if desired.

Notably, in the rear/inner contact subunit 170, the arrangement among the contacts 174 and the insulator 172 and the cable 200 is similar to that in the front/outer contact subunit 160 but in a symmetrical/mirror manner, i.e., in the front/outer contact subunit 160, the braiding layer 206 of the cable 200 being located on an upper side of the corresponding transverse bar of the grounding contacts 165 while that being located on an underside of the corresponding transverse bar of the grounding contacts 175 in the rear/inner contact subunit 170.

Referring to FIGS. 18-22, the sideband contact module 180 includes a plurality of wafers 182 stacked with one another in the transverse direction. Each wafer 182 includes an insulator 184 with a contact set 186 embedded therein via insert-molding. The contact set 186 includes an upper contact unit 187 and a lower contact unit 189 wherein the upper contact unit 187 unitarily forms a pair of contacting arms 196 with respective and spaced front and rear contacting sections in the front-to-back direction, and the lower contact unit 189 unitarily forms a pair of contacting arms 198 with respective and spaced front and rear contacting sections in the front-to-back direction. The upper contact unit 187 further includes a pair of tails 194 spaced from each other in the front-to-back direction. The lower contact unit 189 further includes a pair of tails 192 spaced from each other in the front-to-back direction. Notably, if necessary, the pair of contacting arms 196 can be electrically separated from each other by removing the T-shaped structure (not labeled) located between the corresponding pair of tails 194 because a stamping hole (not labeled) is formed in the insulator 184 to expose such a T-shaped structure. Similarly, the pair of contacting arms 198 can be electrically separated from each other by removing the T-shaped structure (not labeled) located between the corresponding pair of tails 192. In fact, the contacting arms 196 and the contacting arm 198 are not located in a same vertical plane but being offset from each other in the transverse direction. Therefore, the insulator 184 forms a protrusion 183 and a recess 185 on two sides to result in such an offset structure. Such an offset structure also facilitates stacking of the wafers 182 in the transverse direction correctly and stably. Each wafer 182 further forms a protrusion 188 to be received within a corresponding recess formed in the neighboring wafer 182. Each wafer 182 further includes a guiding rib 181 which is received within the corresponding guiding groove 116 when assembled.

Referring to FIGS. 24-28 which show another embodiment same with the first embodiment except the beam 304 of the grounding bar 300 is replaced with the resilient beam 434of the grounding bar 430 to omit the soldering process between the beam 304 and the corresponding grounding contact 175 in the first embodiment. In other words, in this embodiment, the resilient arm 434 mechanically presses the corresponding grounding contact 450 without soldering while the braiding layer 456 is still requisitely soldered upon the transverse bar (not labeled) of the grounding contacts 450. Understandably, in the second embodiment, all other components keep the same with those of the first invention. The front contact subunit includes a plurality of contacts 336 retained in the insulator 332, and the rear contact subunit includes a plurality of contacts 338 retained in the insulator 334. The grounding bar 430 is retained to the insulator 332 via the posts 460. The cable 451 is composed of the inner conductor 452, the inner insulative layer 454, the braiding layer 456 and the outer insulative layer 458. Notably, in the invention the grounding bracket 300, 430 is to essentially mostly cover the exposed inner insulative layer 204, 454 in the vertical direction for reducing the impedance thereof. Notably, the housing 110 forms a plurality of passageways (not labeled) beside the mating slot 111 to receive the contacting sections of the corresponding contacts, respectively. Notably, the contact unit 186 are stamped and operably deflected in the direction perpendicular to the thickness direction while the contacts 164, 174 are stamped and formed and operably deflected in the direction compliant with the thickness direction.

Referring to FIGS. 29-33 which show the third embodiment same with the first embodiment except omit the beam 304 of the metallic grounding bar 500. Understandably, in the third embodiment, all other components keep the same with those of the first invention. The front contact subunit includes a plurality of contacts 536 retained in the insulator 532, and the rear contact subunit includes a plurality of contacts 538 retained in the insulator 534. The contacts 536 includes two pairs of differential pair contacts 546 alternately arranged with three grounding contacts 547 in the transverse direction wherein the tails of the grounding contacts 547 are linked together with a transverse bar 540. The contacts 538 includes two pairs of differential pair contacts 548 alternately arranged with three grounding contacts 549 in the transverse direction wherein the tails of the grounding contacts 547 are linked together with a transverse bar 540 In this embodiment, the metallic grounding bar 500 is not retained to the insulator 532 via the posts 460. The grounding bar 500 comprises two bulged sections 504 and three level sections505. The cable 551 is composed of the inner conductor 552, the inner insulative layer 554, the common metallic shielding layer 556 and the outer insulative layer 558. Each of bulged sections 504 cover the exposed common metallic shielding layer 556 and each of the level section 505 contacted to the corresponding grounding contacts 537. Each of the bulged sections 504 and the level section 505 has holes 510 for solder, through which the metallic grounding bar 500 directly soldered to the transverse bar 540 of the grounding contacts 537 and the common metallic shielding layer 556.

Referring to FIGS. 34-57, show the fourth embodiment of the electrical connector assembly of the present invention. In this embodiment, the electrical connector assembly 800 includes an insulative housing 810 enclosing therein a contact module assembly 820 which includes a sideband contact module 880 sandwiched between a pair of high speed contact module 822, and cables connected to the contact module. The housing 810 forms a front mating slot 811 and a rear receiving cavity 812, and a plurality of securing apertures 814 are formed in the upper and bottom walls of the housing 810 for cooperation with the high speed contact modules 822 of the contact module assembly 820.

Each high speed contact module 822 includes an upper unit 830 and a lower unit 830' stacked with each other in the vertical direction wherein the upper unit 830 and the lower unit 830' are structurally similar/identical to each other and arranged in an essentially symmetrical manner in the vertical direction with a half pitch offset. Based upon the similarity and identicality between the upper unit 830 and the lower unit 830', only the upper unit 130 is described in detail.

The upper unit 830 includes a front/outer contact subunit 860 and a rear/inner contact subunit 870 assembled together as a contact unit by a metallic shell 840. The front/outer contact subunit 860 includes a plurality of contacts 864 integrally formed within a front/outer insulator 862 via insert-molding, and the rear/inner contact subunit 870 includes a plurality of contacts 874 integrally formed with a rear/inner insulator 872 via insert-molding. The contacts 864 includes two pairs of differential pair contacts 866 alternately arranged with three grounding contacts 865 in the transverse direction wherein the tails of the grounding contacts 665 are linked together with a transverse bar (not labeled). The transverse bar unitarily linked with the three grounding contacts.

The front/outer insulator 862 forms a front protrusion 861. A plurality of receiving grooves 867 are formed in an underside of the front/outer insulator 862 for receiving the contacting sections of the corresponding contacts 874 of the rear/inner contact subunit 870.

The contacts 874 include two pairs of differential pair contacts 876 alternately arranged with three grounding contacts 875 wherein the tails of the grounding contacts 875 are linked together via a transverse bar (not labeled). The rear/inner insulator 872 forms a plurality of rear protrusions 873 .wherein the rear edge of the front/outer insulator 862 abuts against the front edge of the rear protrusions 873. The shell 840 comprises a top wall, two side walls extending from the top wall and a front wall 841 extending from the front wall. The front wall 841 of the shell 840 abuts against the front edge of the front protrusion 861. Notably, the contacts 864, 874 are stamped and formed and operably deflected in the direction compliant with the thickness direction. The contacts 864 are edge-to-edge coupled. Similarly, the contacts 874 are edge-to-edge coupled.

Notably, via cooperation of the rear edge of the front/outer insulator 862 and the front edge of the rear protrusions 871, and the front/outer insulator 862 further forms a plurality of side protrusions 863 to be received within the corresponding securing apertures 845, and the rear/inner insulator 872 further forms a plurality of side protrusions 871 to be received within the corresponding securing apertures 846, respectively, thus assuring securement between the shell 840 and the insulators 862, 872 in both the vertical direction and the front-to-back direction. Notably, after assembled, the shell 840 is retained to the front/outer insulator 862 and the rear/inner insulator 872 via engagement of the protrusions 863 and 871 within the corresponding securing apertures 845, 846 with the insulator 862 is sandwiched between the shell 840 and the insulator 872 in the vertical direction. The shell 840 of the upper unit 830 further forms a pair of retention sections 844 to retain to the corresponding retention sections 844' of the shell of the lower unit 830'. The insulator 872 forms a pair of upper passages 852 in an upper side to receive the corresponding two cables which are linked to the upper unit 860, and a pair of lower passages 852 to receive the two corresponding cables which are linked to the lower unit 870. The shell 840 further includes a securing tang 842 which will be securely retained in the securing aperture 814 when the contact module assembly 820 is assembled into the housing 810.

The sideband contact module 880 includes an upper contact set 882 and a lower contact set 882' stacked with each other in the vertical direction, wherein the upper set 882 and the lower set 882' are structurally similar/identical to each other and arranged in an essentially symmetrical manner in the vertical direction, thus saving the manufacturing cost on the mold designs. Based upon the similarity and the identicality between the upper set 882 and the lower set 882', only the upper set 882 is described in detail.

The upper contact set 882 includes an insulator 884, a plurality of upper contacts 887 installed within the insulator 884 via assembled from the upper side insulator 884, and a plurality of lower contacts 889 installed within the insulator 884 via assembled from the lower side of the insulator 884. The upper contacts 887 arranged in the transverse direction, each of the upper contact 887 comprise contacting arms 896 and tail 894. The wide side of the tail 894 and the wide side of the contacting arms 896 are in different planes. The contacting arms 896 of adjacent upper contacts 887 are wide-to-wide coupled. The tails 894 of adjacent upper contacts 887 are edge-to-edge coupled. Notably, the structure of the lower contacts 889 and the upper contact 887 are similarity. The lower contacts 889 arranged in the transverse direction. Each of the lower contact 889 comprises a rear contacting arms 898 and lower tail 892. The contacting arms 896 and the rear contacting arms 898 are arranged in the front to back direction. The wide side of the tail 892 and the wide side of the contacting arms 898 are in different planes. The rear contacting arms 898 of adjacent lower contacts 889 are wide-to-wide coupled. The tails 892 of adjacent lower contacts 889 are edge-to-edge coupled. In fact, the contacting arms 896 and the rear contacting arm 898 are not located in a same vertical plane but being offset from each other in the transverse direction.

The cable includes high speed cable 910 connected to the high speed contact module and sideband cable 920 connected to the sideband contact module, the high speed cable 910 includes a pair of inner conductors 902, a pair of inner insulative layer 904, a common shielding layer 906, a common outer insulative layer sequentially arranged with one another and a pair of ground wires 907 between the shield and insulation. The inner conductor 902 is soldered to the tail of the differential pair contacts 866, the pair of ground wires 907 is mechanically and electrically connected to the grounding contacts 865. The sideband cable 920 includes an inner conduct 921 which is soldered to the upper surface of the tail 894 of the upper contacts 887. Notably, the inner conduct 921 of the sideband cable 920 is soldered to the lower surface of the tail 892 of the lower contacts 889.

The electrical connector assembly 100,800 further includes a cage 950 that has a receiving space and can be mounted on an external circuit board (not shown). The cage 950 comprises an upper wall 951, two side walls 953, a lower wall, and a middle wall 956. The middle wall 956 divides the receiving space into two cavities 960 stacked up and down. Each of the cavities 960 can receive the electrical connector assembly mentioned in any of the above embodiments. The middle wall 956 of the cage 950 has a tongue 970 inserted to the electrical connector assembly housing to control interface true position. The cage 950 has four springs 958 at two sides thereof for holding the electrical connector assemblies in position.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

an insulative housing with a front mating slot and a rear receiving cavity;

a combo contact module assembly received within the receiving cavity and including a sideband contact module sandwiched between a pair of high speed contact modules in a transverse direction;

each high speed contact module including an upper unit and a lower unit configured to be assembled with each other in a vertical direction perpendicular to the transverse direction;

the upper unit and the lower unit being basically symmetrically arranged with each other in the vertical direction; and a metallic shell; wherein each of the upper unit and the lower unit includes a front subunit and a rear subunit stacked with each other in the vertical direction and retained together by the metallic shell;

the front subunit includes a plurality of contacts integrally formed within a front/outer insulator via insert-molding, and the rear subunit includes a plurality of contacts integrally formed with a rear/inner insulator via insert-molding; and the rear/inner insulator forms a protrusion, and a rear edge of the front/outer insulator abuts against a front edge of the protrusion.

2. The electrical connector assembly as claimed in claim 1, wherein the shell comprises a front wall abuts against the front edge of the front protrusion.

3. The electrical connector assembly as claimed in claim 2, wherein each of the front/outer insulator and the rear/inner insulator further forms a plurality of side protrusions to be received within the corresponding securing apertures of the shell, respectively.

4. The electrical connector assembly as claimed in claim 3, wherein the shell of the upper unit further forms a pair of retention sections to retain to the corresponding retention sections of the shell of the lower unit .

5. An electrical connector assembly comprising:

an insulative housing with a front mating slot and a rear receiving cavity; and a combo contact module assembly received within the receiving cavity and including a sideband contact module sandwiched between a pair of high speed contact modules in a transverse direction; wherein each of the high speed contact modules comprises edge coupled contacts and the sideband contact module comprises broadside coupled contacts;

each high speed contact module includes an upper unit and a lower unit assembled with each other in a vertical direction, the sideband contact module includes an upper contact set and a lower contact set stacked with each other in the vertical direction; and each of the upper unit and the lower unit includes a front subunit and a rear subunit, and each of the front subunit and the rear subunit includes differential pair contacts alternately arranged with grounding contacts in a transverse direction and commonly embedded within an insulator via insert-molding.

6. The electrical connector assembly as claimed in claim 5, wherein each of the upper contact set and the lower contact set comprises an insulator, a plurality of upper contacts and a plurality of lower contacts installed within the insulator via assembling.

7. The electrical connector assembly as claimed in claim 6, each of the upper contact and the lower contact comprises a contact arm and a tail, and a wide side of the tail and a wide side of the contact arm are in different planes.

8. An electrical connector assembly comprising:

an insulative housing with a front mating slot and a rear receiving cavity; and a combo contact module assembly received within the receiving cavity and including a sideband contact module sandwiched between a pair of high speed contact modules;

a cage including two cavities stacked up and down; wherein each of the high speed contact modules comprises edge coupled contacts and the sideband contact module comprises broadside coupled contacts, and one of the two cavities of the cage receives the insulative housing receiving the combo contact module assembly.

9. An electrical connector assembly comprising:

a first insulative housing having a front mating slot and a rear receiving cavity, a first combo contact module assembly received within the receiving cavity and including a sideband contact module sandwiched between a pair of high speed contact modules, and a plurality of first cables connected to the first combo contact module assembly;

a second insulative housing having a front mating slot and a rear receiving cavity, a second combo contact module assembly received within the receiving cavity and including a sideband contact module sandwiched between a pair of high speed contact modules, and a plurality of second cables connected to the second combo contact module assembly; and a cage including an upper cavity and a lower cavity stacked up and down; wherein each of the high speed contact modules of the first and second combo contact module assemblies comprises edge coupled contacts and each of the sideband contact modules of the first and second combo contact module assemblies comprises broadside coupled contacts, the upper cavity receives the first combo contact module assembly, and the lower cavity receives the second combo contact module assembly.

* * * * *